US006091364A

United States Patent [19]

Murakami et al.

[11] Patent Number: 6,091,364

[45] **Date of Patent: *Jul. 18, 2000**

[54] ANTENNA CAPABLE OF TILTING BEAMS IN A DESIRED DIRECTION BY A SINGLE FEEDER CIRCUIT, CONNECTION DEVICE THEREFOR, COUPLER, AND SUBSTRATE LAMINATING METHOD

[75] Inventors: Yasushi Murakami, Yokohama; Akihiro Tsujimura, Isehara; Hisao Iwasaki, Tama; Hiroki Shoki, Kawasaki; Hidehiro Matsuoka, Yokohama, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,751

[22] Filed: Jun. 30, 1997

[30] Foreign Application Priority Data

Jun. 28, 1996 [JP] Japan ..... 8-170198
Jan. 9, 1997 [JP] Japan ..... 9-002366

[51] Int. Cl.[7] ..... H01Q 1/38

[52] U.S. Cl. ..... 343/700 MS; 343/846

[58] Field of Search ..... 343/700 MS, 846

[56] References Cited

U.S. PATENT DOCUMENTS 4,329,689 5/1982 Yee ..... 343/700 MS
4,389,651 6/1983 Tomasky ..... 343/846
5,043,738 8/1991 Shapiro et al. ..... 343/700 MS
5,543,811 8/1996 Chethik ..... 343/844

OTHER PUBLICATIONS

R. Mittra, et al., "Microstrip Patch Antennas for GPS Applications," Antennas Propagat. Digest, IEEE AP–S Intl. Symp., IEEE, May 1993.

N. Terada, Autumn Meetings of Electronic Information Communication Society (Japan), B–84, p. 2–84, 1992, "Mode Synthesized Annular Ring Microstrip With Squint Beam".

*Primary Examiner*—Frank G. Font
*Assistant Examiner*—Tu T. Nguyen
*Attorney, Agent, or Firm*—Oblon, Spivak, McClelland, Maier & Neustadt, P.C.

[57] ABSTRACT

A patch having a circular shape for instance is formed on the main surface of a substrate in the shape of, for example, an equilateral triangle. The center of the main surface of the patch is at a position different from the center of the substrate. A grounding conductor is disposed on the backside of the substrate. Power is supplied to the patch through, for example, a microstrip line, triplate line, coplanar waveguide, slot line or the like. An antenna configured as described above has the center of the patch at a position different from the center of the triangle substrate, so that beams can be tilted in a desired direction by a single patch and a single feeder circuit.

12 Claims, 25 Drawing Sheets

ANTENNA CAPABLE OF TILTING BEAMS IN A DESIRED DIRECTION BY A SINGLE FEEDER CIRCUIT, CONNECTION DEVICE THEREFOR, COUPLER, AND SUBSTRATE LAMINATING METHOD

BACKGROUND OF THE INVENTION

1. Field of the Invention

The invention relates to an antenna, a connection device, a coupler and a substrate laminating method which are used for a premises radio communication system for instance.

2. Description of the Related Art

An antenna to be used for this type of system is required to tilt beams in a desired direction. For example, "Oblique Beam Achieving Mode Compounding Type Circular Microstrip Antenna" by Tsuneyoshi TERADA, Autumn Meeting of Electronic Information Communication Society, 1992 (Japan) B-84 describes a microstrip antenna which tilts beams in a desired direction. The antenna described in this paper has a plurality of ring microstrip antennas formed concentrically in the same plane, one of the microstrip antennas is excited in a TM110 mode, the other microstrip antennas are excited in a high-order mode such as a TM210 mode, and the radiation patterns of these antennas are combined, thus beams from the front direction are tilted.

But, since electric power is required to be supplied to the plurality of ring microstrip antennas at a desired exciting amplitude difference and phase difference, an antenna element and a feeder circuit are separately needed, resulting in a high production cost. And, since the number of components is increased, downsizing is hindered.

SUMMARY OF THE INVENTION

It is an object of the invention to provide an antenna which can tilt beams in a desired direction by a single radiation element and a single feeder circuit.

It is another object of the invention to provide an antenna which can be produced at a low production cost.

It is another object of the invention to provide an antenna which can be made compact by decreasing the number of components.

It is another object of the invention to provide an antenna which can direct beams in a vertical direction with respect to a substrate even when the substrate is asymmetrical.

It is another object of the invention to provide an antenna which can have a high gain in a vertical direction with respect to a substrate even when the substrate is asymmetrical.

It is another object of the invention to provide an antenna which can tilt beams in the direction of a desired elevation angle and can change the direction of beams in a declination direction.

It is another object of the invention to provide a connection device which can reduce an insertion loss on a line.

It is another object of the invention to provide a connection device which enables assembling by a general-purpose jig.

It is another object of the invention to provide a connection device which enables to decrease the number of assembling steps.

It is another object of the invention to provide an antenna that an opening is not filled with a solder, a coupler, and a substrate laminating method.

It is still another object of the invention to provide an antenna which is produced at a yield, a coupler, and a substrate laminating method.

The antenna according to the invention comprises a triangle substrate having a first surface; and a radiation device which is disposed on the substrate so as to have a center at a position different from the center of the first surface.

The antenna according to the invention comprises a substrate having a first end portion and a second end portion which are on a straight line passing though a center of a main surface and have a different shape to each other; a radiation device which is disposed on the substrate so as to have the center of the main surface at a position different from the center of the substrate; and a feeder portion for supply power to the radiation device.

The substrate can be a dielectric substrate or a semiconductor substrate for instance. The dielectric substrate can have air, foamed material, honeycomb material or the like as the main material, or may use them in combination. The semiconductor substrate can be gallium arsenide, silicon or the like as the main material, or may use them in combination. And, the dielectric substrate can be used in combination with the semiconductor substrate or the like. On the semiconductor substrate, a passive circuit or an active circuit can be formed.

The substrate has typically a triangle shape such as an isosceles triangle or an equilateral triangle, but it is not limited to such a shape and may also be polygonal such as a pentagon.

The radiation device is typically circular but may have any shape such as rectangular, triangle or annulus ring as far as the effects as the antenna element are not deteriorated.

The feeder portion may be a coaxial feeder, slot feeder, direct feeder or the like.

The invention is not limited to a linearly polarized wave but can also be applied to a circularly polarized wave.

The antenna according to the invention has a ground plane on the backside of the substrate or on the inner layer of the substrate in the case of the slot feeder. But, where a mating side has a ground plane or a portion which can be a ground plane on which the antenna of the invention is disposed, the antenna of the invention may not have the ground plane.

The antenna according to the invention comprises a pyramidal three-dimensional substrate which is formed by assembling at least three triangle substrates having a common apex; a radiating element which is disposed on the respective triangle substrates so as to have the center of the main surface on a straight line running through the apex and the center of the main surface of each triangle substrate but at a position different from the center of the each triangle substrate; and a feeder portion for supplying power to the respective radiating elements.

The antenna according to the invention has a pyramid three-dimensional substrate which is shaped like a so-called pyramid, and the radiating element described above is disposed on each side of the substrate.

The connection device according to the invention comprises a first substrate on which a first microstrip line is formed; a second substrate that a second microstrip line is formed on its flat portion and its continuous curved potion; and a connection part which connects the first microstrip line and the second microstrip line formed on the curved portion within the flat surface containing the first substrate.

The substrate can be a dielectric substrate, a semiconductor substrate or the like same as in the antenna described above. The dielectric substrate can have air, foamed material, honeycomb material or the like as the main material, or may use them in combination. The semiconductor substrate can be gallium arsenide, silicon or the like as the main material, or may use them in combination. And, the dielectric substrate can be used in combination with the semiconductor substrate or the like. On the semiconductor substrate, a passive circuit or an active circuit can be formed. The connection part can be a gold wire or a gold ribbon.

The connection device according to the invention does not have the bent part formed at the adjacent part between the substrate and the substrate but formed on the second substrate, so that the connection part, e.g., the gold line or gold ribbon, can be made short. Therefore, an unneeded inductance or capacitance can be reduced. In addition, since the connection is made between the substrates on the flat portion, the conventional technology can be employed as it is, assembling can be made using a general-purpose jig, and the number of assembling steps can be decreased.

The connection device according to the invention comprises a first substrate on which a first slot line is formed; a second substrate which is disposed next to the first substrate, has an inclined angle with respect to the first substrate, and has a second slot line formed so as to continue to the first slot line; and a connection part for connecting the first slot line and the second slot line.

The connection device according to the invention comprises a first substrate on which a first coplanar waveguide is formed; a second substrate which is disposed next to the first substrate, has an inclined angle with respect to the first substrate, and has a second coplanar waveguide formed so as to continue to the first coplanar waveguide; and a connection part for connecting the first coplanar waveguide and the second coplanar waveguide.

When the slot line is used, the connection part between the first and second lines can be formed of, for example, a gold ribbon having a large area, and an unneeded inductance can be reduced. And, the slot line or the coplanar waveguide which has an electric field in it is parallel to the substrate, so that degradation of characteristics due to bending is smaller than when the electric field is perpendicular to the substrate in the microstrip line. In other words, these connection devices can minimize a loss even when the bent portion is at the adjacent part between the substrate and the substrate.

The antenna according to the invention comprises a first grounding conductor having a first opening; a second grounding conductor which is bonded to the first grounding conductor with a solder and has an opening which has an area larger than the first opening and surrounds the first opening; first and second dielectric substrates which are disposed to hold the first and second grounding conductors therebetween; and a feeder line and a radiation conductor which are formed on each main surface of the first and second dielectric substrates.

The antenna according to the invention comprises a first dielectric substrate on which a first grounding conductor having a first opening is formed; a second dielectric substrate which has a conductor portion formed on a solder portion applied between the second dielectric substrate and the first grounding conductor; a solder which is placed between the first grounding conductor of the first dielectric substrate and the conductor of the second dielectric substrate; and a feeder line and a radiation conductor which are formed on the respective main surfaces of the first and second dielectric substrates.

The coupler according to the invention comprises a first grounding conductor having a first opening; a second grounding conductor which is adhered to the first grounding conductor with a solder, and has a second opening with an area larger than the first opening and surrounding the first opening; a first dielectric substrate and a second dielectric substrate which are disposed to hold the first and second grounding conductors therebetween; and a feeder line which is formed on the respective main surfaces of the first and second dielectric substrates.

The coupler according to the invention comprises a first dielectric substrate on which a first grounding conductor having a first opening is formed; a second dielectric substrate which has a second grounding conductor formed on a solder portion applied between the second dielectric substrate and the first grounding conductor; a solder which is placed between the first grounding conductor of the first dielectric substrate and the second grounding conductor of the second dielectric substrate; and a feeder line which is formed on the respective main surfaces of the first and second dielectric substrates.

The substrate laminating method according to the invention comprises a step of forming a first conductor plate having a first opening on a first substrate; a step of forming a second conductor plate, which has a second opening with an area larger than the first opening and surrounds the first opening, on a second substrate; a step of disposing a solder on the conductor plate surface of at least one of the substrates; a step of disposing the two substrates to oppose mutually so as to surround the first opening by the second opening; and a step of connecting grounding conductors mutually by melting the solder.

The substrate laminating method according to the invention comprises a step of forming a first conductor plate having a first opening on a first substrate; a step of forming a second conductor plate, which is positioned on the side of a solder applying portion between the second conductor plate and the first conductor plate, on a second substrate; a step of disposing a solder on the conductor plate surface of at least one of the substrates; a step of disposing the two substrates to oppose mutually so that the second conductor plate is opposed to a predetermined position of the first conductor plate; and a step of connecting the grounding conductors mutually by melting the solder.

According to the invention, by removing from the second grounding conductor (the second conductor plate) the conductor in the neighborhood of the first opening of the first grounding conductor (the first conductor plate), for example, the joining opening, the solder which was flown in when it was reflowed flows where the grounding conductors are on both surfaces to connect electrically the grounding conductors mutually, but the solder does not flow into the neighborhood of the joining opening because metal is limited to be on the first grounding conductor only. Therefore, the joining opening is free from being filled. In addition, the conventional technology had a disadvantage that power was attenuated by a magnitude corresponding to the metal of the grounding conductor or the adhesive agent. But, by removing metal so as to form, for example, a thin metal waveguide by a removed portion, attenuation of power for the metal thickness can be reduced, and feeding can be made without suffering from a large loss.

BRIEF DESCRIPTION OF THE DRAWINGS

FIG. 2B is moved.

DESCRIPTION OF THE PREFERRED EMBODIMENTS

Figure 1A:
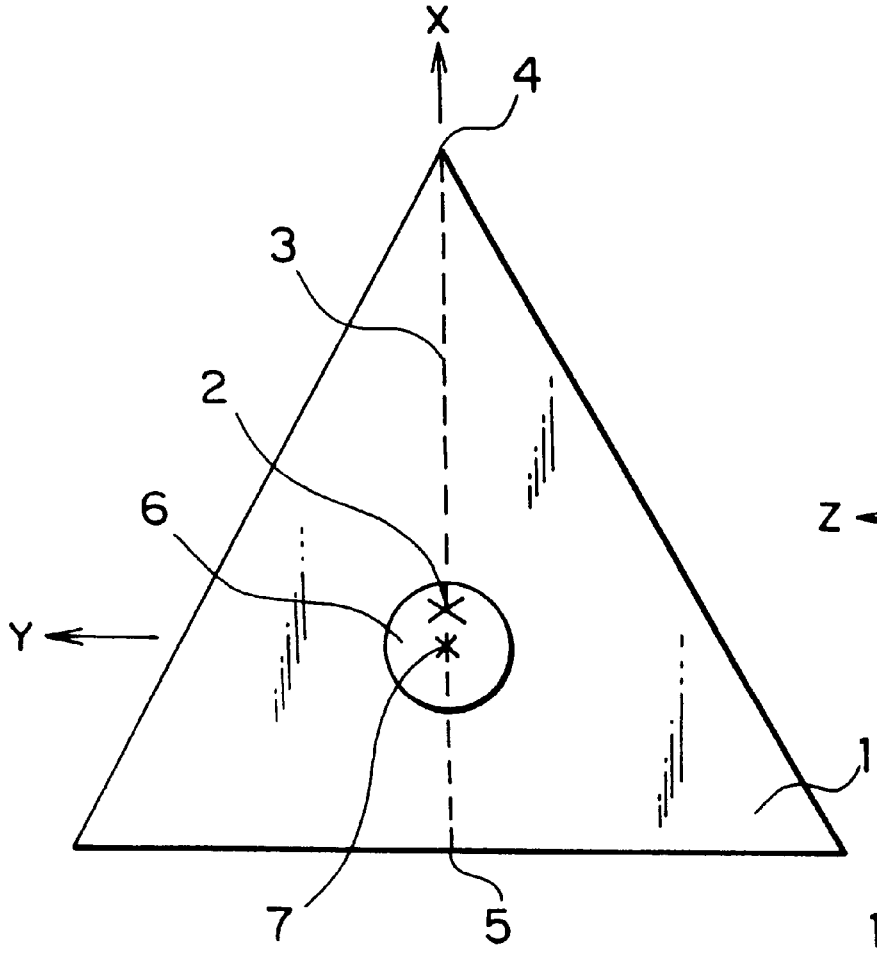
FIG. 1A is a plane view illustrating the principle of the microstrip antenna of the invention.
Figure 1B:
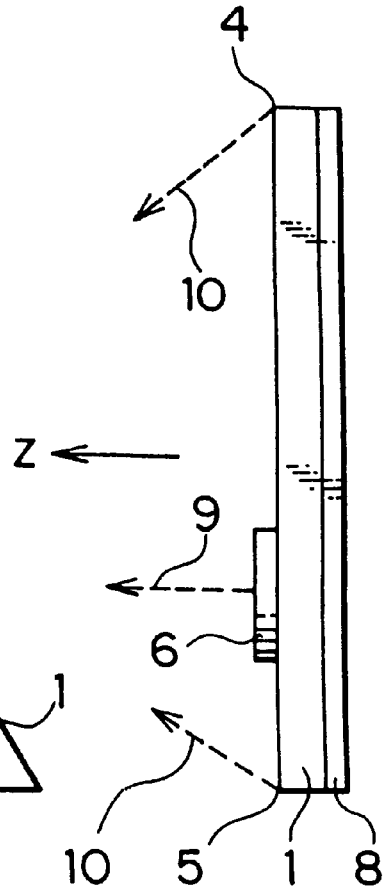
FIG. 1B is a vertical sectional view illustrating the principle of the microstrip antenna of the invention.

FIGS. 1A and 1B are diagrams illustrating the principle of the invention.

In FIGS. 1A and 1B, reference numeral 1 denotes a substrate having a triangle shape for instance. In this triangle substrate 1, a first end portion 4 and a second end portion 5 which are on a straight line 3 passing though a gravitational center 2 on a main surface have an acute angle and a linear form respectively, namely the first end portion 4 and the second end portion 5 have a different form, respectively.

A center 7 on a main surface of a radiating element 6 is located different from the gravitational center 2 of the substrate 1. Specifically, the center 7 of the radiating element 6 is located different from the gravitational center 2 on the straight line 3 of the substrate 1.

And, a grounding conductor 8 is disposed on the backside of the substrate 1.

When transmission output is fed from a feed line (not shown) as feeder portion disposed on the same surface as the radiating element 6 or on the backside of the substrate 1, electromagnetic waves are emitted from the radiating element 6. The emitted electromagnetic waves include a direct wave 9 which is directly radiated from the radiating element 6 to free space and a diffracted ray 10 which is radiated into free space when the electromagnetic waves radiated from the radiating element 6 are diffracted at the end portion of the substrate 1. And a radiation pattern is generally determined by combination of the direct wave 9 and the diffracted ray 10.

The direct wave 9 is determined by the shape, size the radiating element 6, or the dielectric constant, thickness of a substrate, or frequency and does not rely on the size or shape of the substrate 1. Therefore, a maximum radiation direction is determined by the above-mentioned conditions. On the other hand, the diffracted ray 10 is determined by the size or shape of the end portions of the substrate 1. For example, in the neighborhood of the first end portion 4 having the acute angle, a current density is high and therefore the diffracted ray 10 to be radiated into free space is intense, and in the neighborhood of the second end portion 5 having the straight shape, a current density is low and therefore the diffracted ray 10 to be radiated into free space is weak. In other words, by forming the end portions 4, 5 into a different shape, the diffracted ray can be made asymmetry between the end portions 4 and 5 (first parameter). In addition, the invention has the center 7 of the radiating element 6 positioned on the straight line 3 but different from the gravitational center 2 of the substrate 1, so that the diffracted ray can be asymmetry between the terminal portions 4 and 5 (second parameter). The invention adjusts the first and second parameters well to tilt the beam in a desired direction.

The above description was made about transmission, but it is also applied to reception except that the route is reversed. In addition to the application as a two-way antenna, the antenna according to the invention can also be used for transmission only or reception only.

Figure 33:
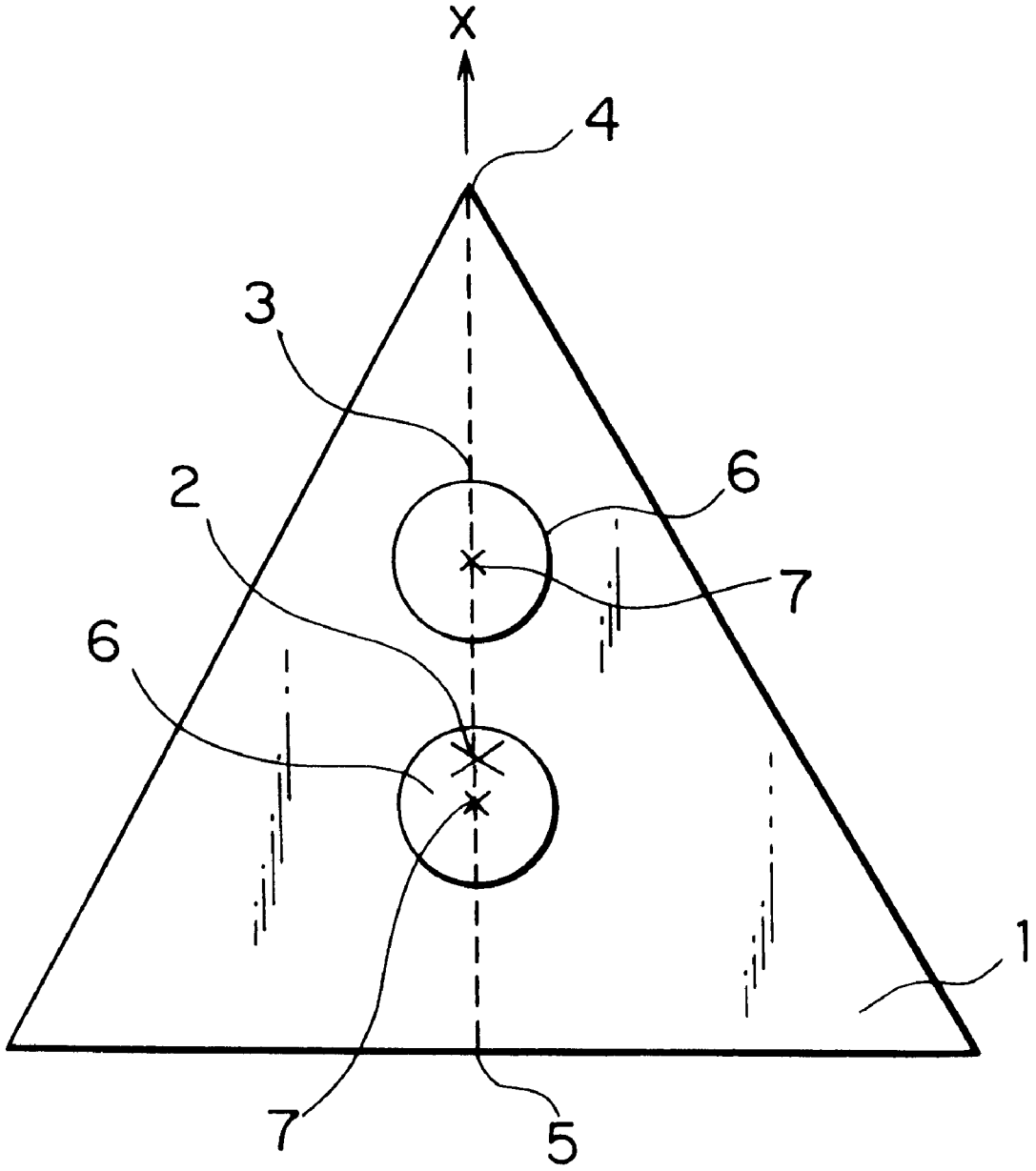
FIG. 33 is a diagram showing a modified embodiment of the antenna shown in FIGS. 1A and 1B.

As shown in FIG. 33, the radiating element 6 may be multiple, e.g., two. Thus, a gain can be improved.

Figure 2A:
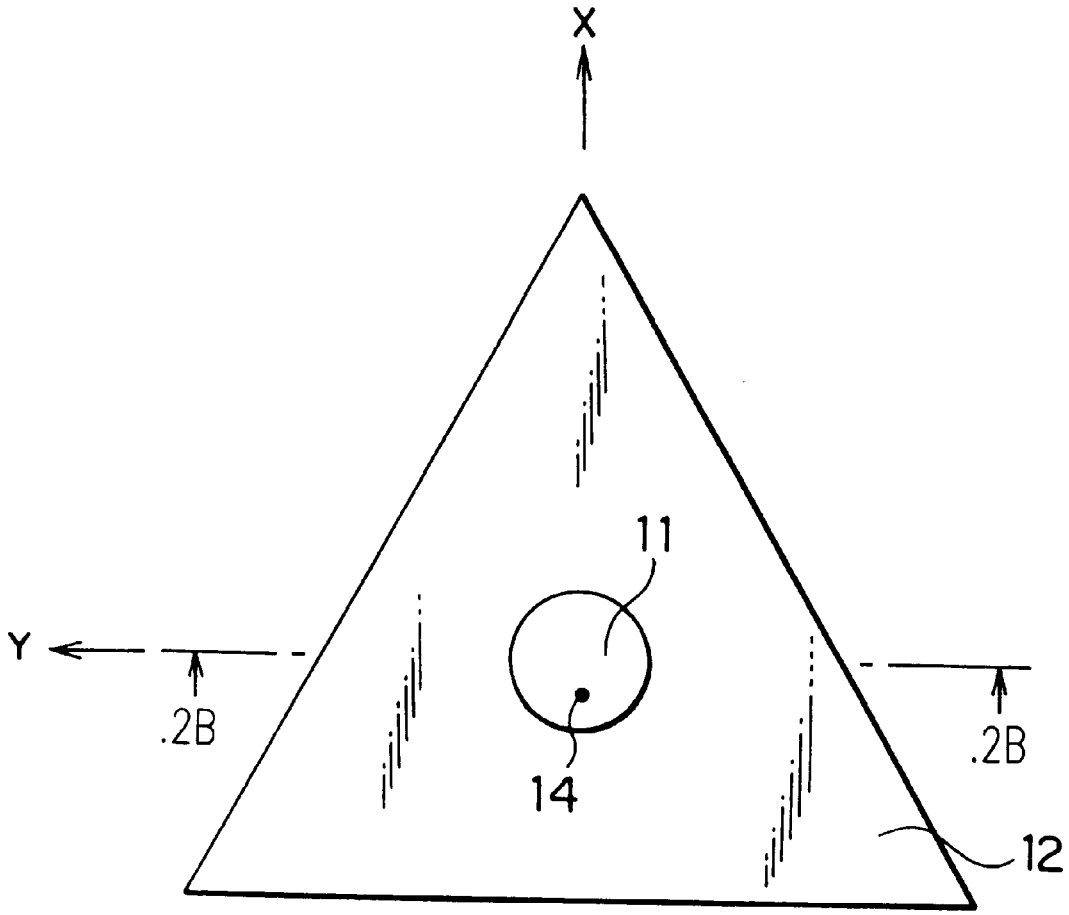
FIG. 2A shows a plan view of the microstrip antenna according to a first embodiment of the invention.
Figure 2B:
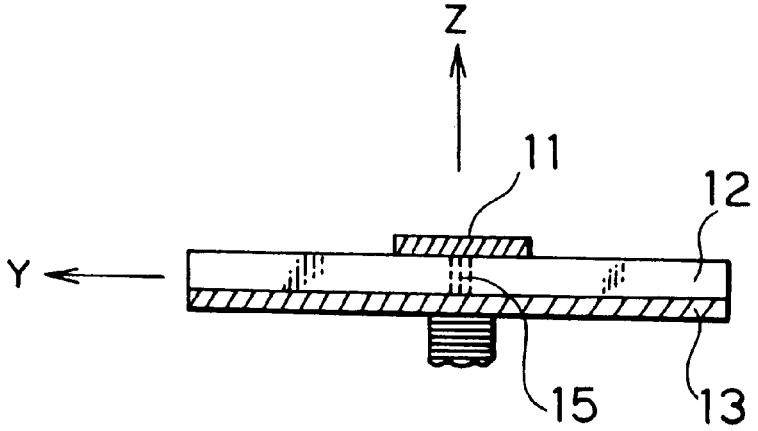
FIG. 2B shows a vertical sectional view of the microstrip antenna according to a first embodiment of the invention.

FIG. 2A is a plan view of the microstrip antenna according to a first embodiment of the invention, and FIG. 2B is a vertical sectional view taken along line A–A' of FIG. 2A.

The microstrip antenna of this embodiment has a dielectric substrate 12 as the substrate held between a circular radiation conductor 11 as the radiating element and a grounding conductor plate 13 as the base conductor. The dielectric substrate 12 and the grounding conductor plate 13 are formed into an equilateral triangle. Power is supplied to the circular radiation conductor 11 by connecting a coaxial line 15 from the grounding conductor 13 to a feed point 14.

The inventors prototyped the microstrip antenna shown in FIG. 2A and FIG. 2B to measure a radiation pattern. The prototype microstrip antenna has the following parameters.

Figure 3:
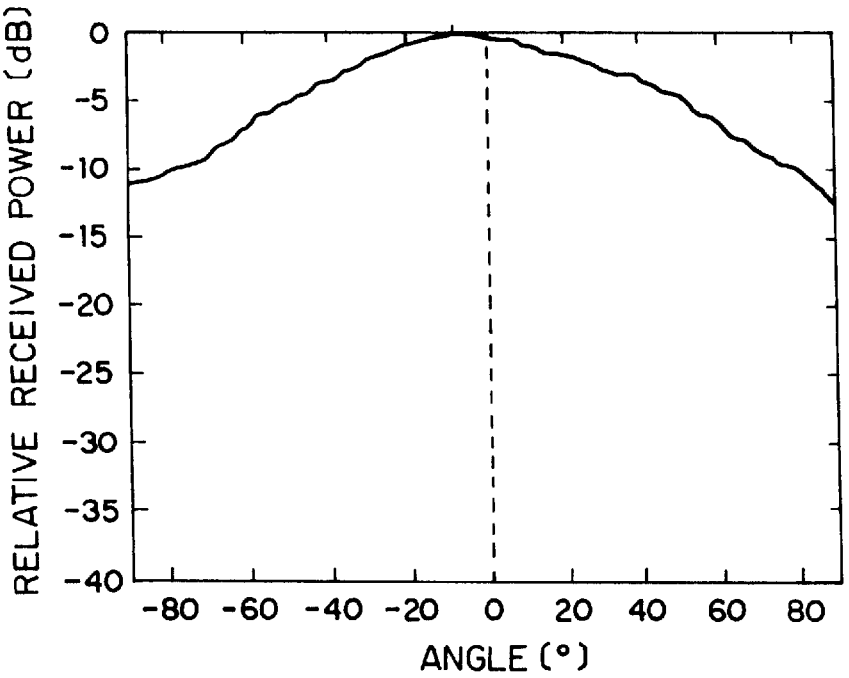
FIG. 3 is a graph showing a radiation pattern on E-plane (X-Z plane) of the microstrip antenna of FIGS. 2A and 2B.
Figure 4:
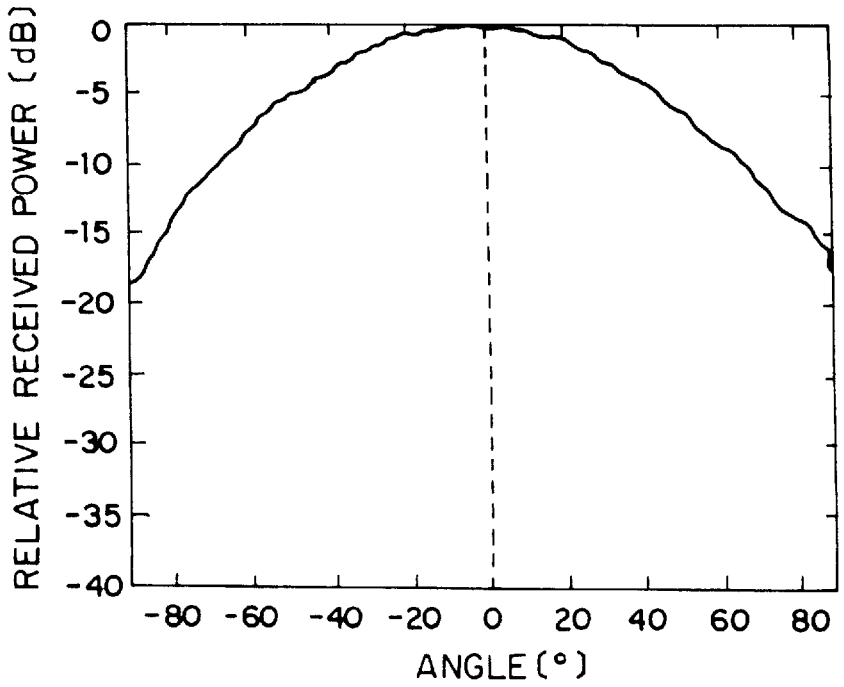
FIG. 4 is a graph showing a radiation pattern on H-plane (Y-Z plane) of the microstrip antenna of FIGS. 2A and 2B.

(a) Dielectric constant of the dielectric substrate 12: 2.60
(b) Thickness of the dielectric substrate 12: 0.8 mm
(c) Radius of the circular radiation conductor 11: 10.5 mm
(d) Shape of the dielectric substrate 12 and the grounding conductor plate 13: Equilateral triangle
(e) Length of one side of the dielectric substrate 12 and the grounding conductor plate 13: 12 cm
(f) Center frequency: 4.987 GHz
(g) Center of the circular radiation conductor 11=Center of the equilateral triangle of the dielectric substrate 12
(h) Polarized wave: Linearly polarized wave parallel to X axis FIG. 3 and FIG. 4 are graphs showing radiation patterns of the microstrip antenna shown in FIG. 2. FIG. 3 shows the radiation pattern of a E-plane (X-Z plane), and FIG. 4 shows the radiation pattern of a H-plane (Y-Z plane). It is apparent from FIG. 3 that a maximum power reception direction is shifted from the front toward a base by −7.0°. The positive direction of X axis was determined as positive direction of θ. On the other hand, FIG. 4 shows that the maximum power reception direction remains at the front. It is obvious that with the dielectric substrate 12 which is an equilateral triangle, even when the center of the circular radiation conductor 11 is positioned at the center of the triangle, the beam is not directed to the front in the X-Z plane.

Figure 5:
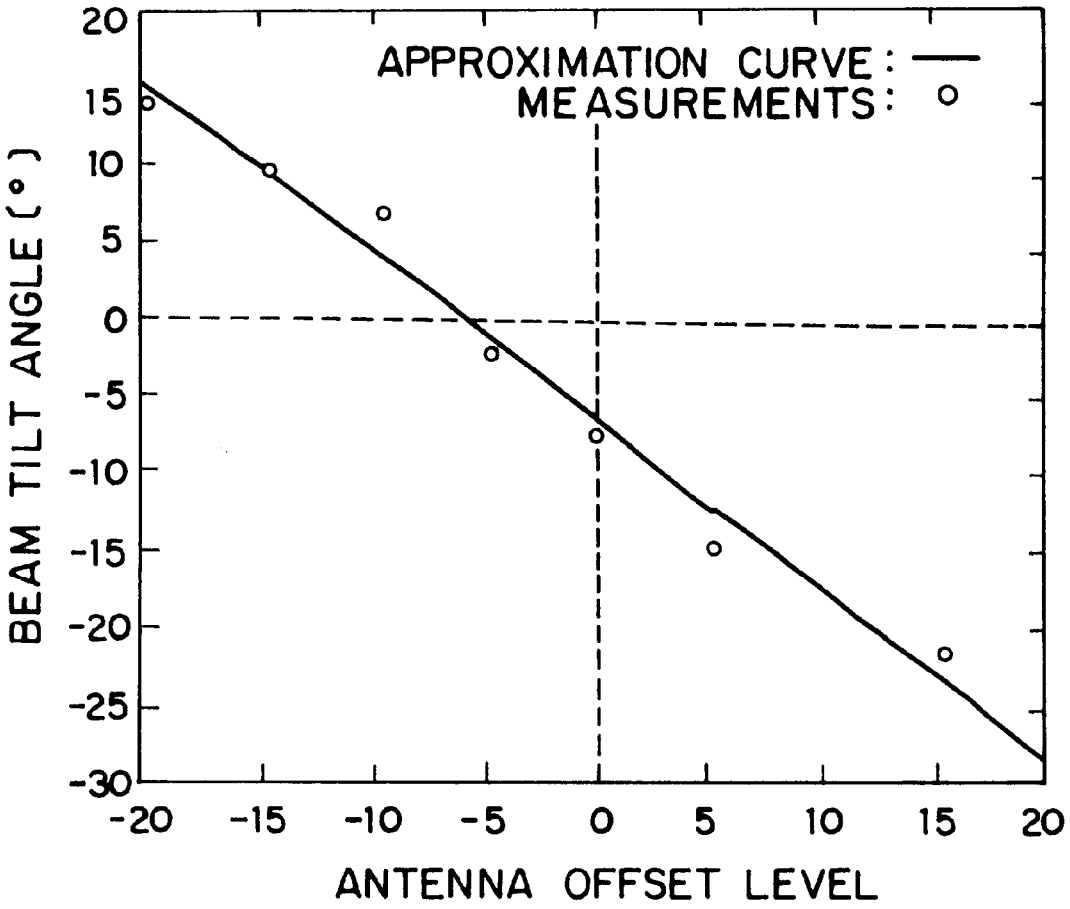
FIG. 5 is a graph showing that the direction of a maximum received power is changed when a radiation conductor's position of the microstrip antenna shown in FIG. 2A

FIG. 5 shows the result of changes of the maximum power reception direction when the circular radiation conductor 11 was moved along X axis. In the drawing, dots indicate measurements and the solid line indicates an approximate line which was obtained from the measurements by a method of least squares. And, the maximum power reception direction is expressed as follows.

Maximum power reception direction [°]=

$$-1.07\times\text{offset level [mm]}-6.24 \quad (1)$$

At the time, the positive direction of X axis was determined as positive direction of θ. In the above equation (1), the offset level was obtained by determining to be plus the positive direction along the X axis with the center of the equilateral triangle as origin. And the direction the beam is tilted was obtained by determining to be plus the positive direction of the X axis with the base as origin. By changing the mounted position of the circular radiation conductor 11, the beam can be inclined from the front direction. It is seen from the results shown in FIG. 3 to FIG. 5 that the beam can be tilted in a desired direction by positioning the center of the circular radiation conductor 11 displaced by a required distance from the center of the triangle of the dielectric substrate 12.

On the other hand, when it is assumed that one side of the triangle of the dielectric substrate 12 and the grounding conductor plate 13 has a length of 2 λ and the circular radiation conductor 11 has a diameter of 0.4 λ, the beam could be pointed in the direction of Z axis (zenith direction) by positioning the center of the circular radiation conductor 11 displaced by 0.15 λ in the negative direction along X axis from the center of the triangle of the dielectric substrate 12. Especially, a high gain can be obtained because the direct wave and the diffracted ray have a matched direction.

Description will be made of a second embodiment.

Figure 6A:
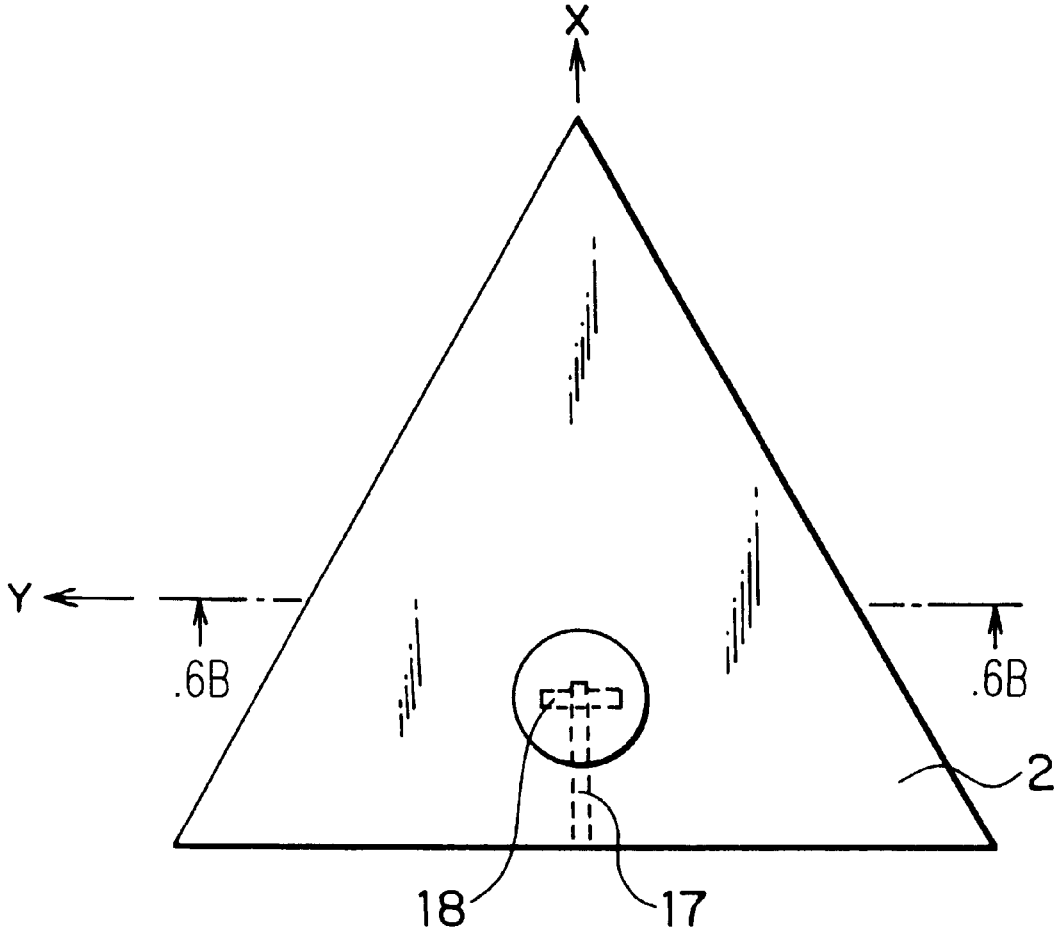
FIG. 6A shows a plan view of the microstrip antenna according to a second embodiment of the invention.
Figure 6B:
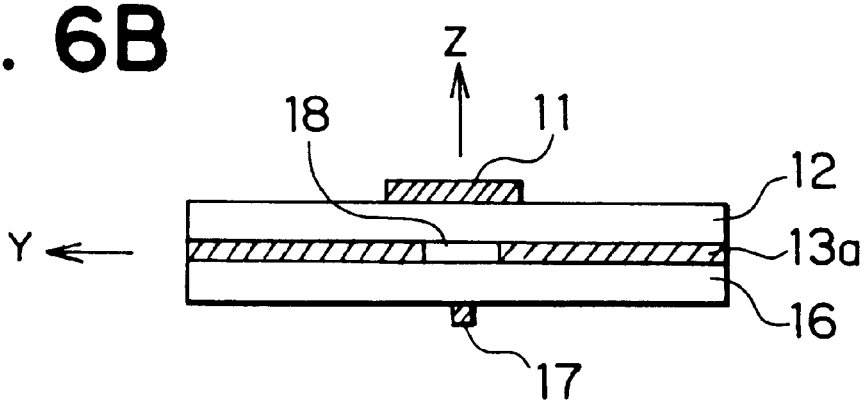
FIG. 6B shows a vertical sectional view of the microstrip antenna according to a second embodiment of the invention.

FIG. 6A is a plan view of the microstrip antenna according to the second embodiment of the invention, and FIG. 6B is a vertical sectional view taken along line B–B' of FIG. 6A.

The microstrip antenna of the second embodiment is different from the one of the first embodiment on the point that a slot coupling feeding method is adopted for the feed portion. Specifically, a second dielectric substrate 16 is stacked on the surface of a grounding conductor 13*a* opposite from its surface faced to a dielectric substrate 12, a feed line 17 is formed on the surface of the second dielectric substrate 16 opposite from its surface faced to the grounding conductor 13*a*, and the feed line 17 is connected electromagnetically to the radiation conductor 11 through a slot 18 formed in the grounding conductor 13*a*. In this configuration, when the second dielectric substrate 16 has the same shape as the first dielectric substrate 12, its characteristics can be the same as in the first embodiment.

Figure 7:
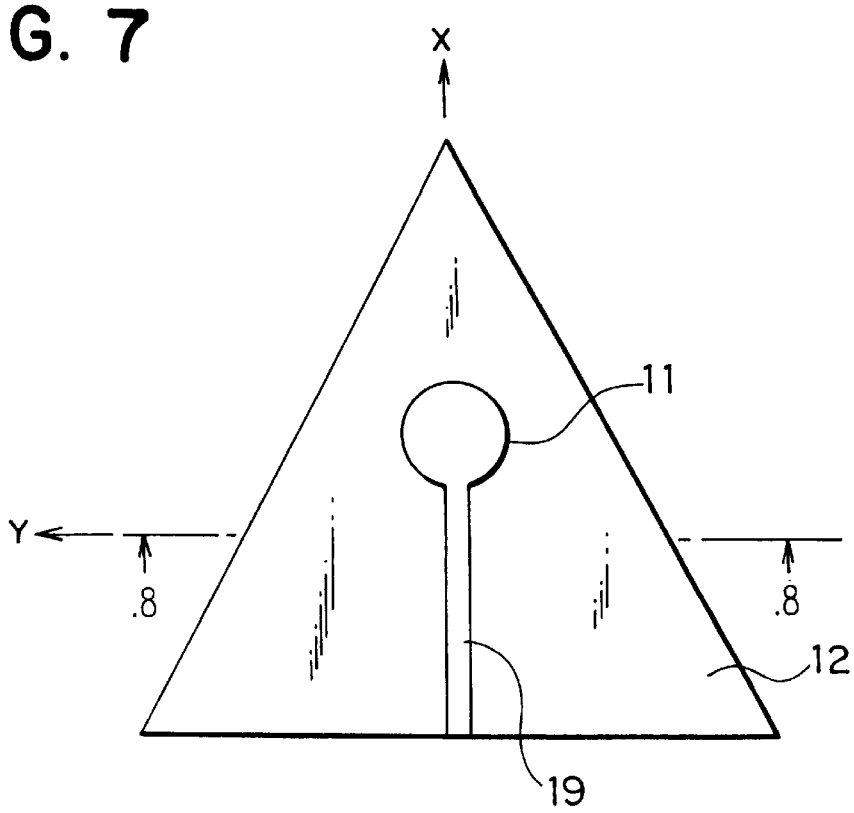
FIG. 7 is a plan view of the microstrip antenna according to a third embodiment of the invention.

FIG. 7 shows a plan view of the microstrip antenna according to a third embodiment of the invention.

The microstrip antenna of the third embodiment is different from those of the first and second embodiments on the point that a direct feeding method is adopted for the feed portion. Specifically, a feed line 19 is formed on the surface of the dielectric substrate 12 where the radiation conductor 11 is formed, and the feed line 19 is connected to the radiation conductor 11. In this configuration, the characteristics same as those in the first embodiment can be obtained.

Description will be made of a fourth embodiment.

Figure 8:
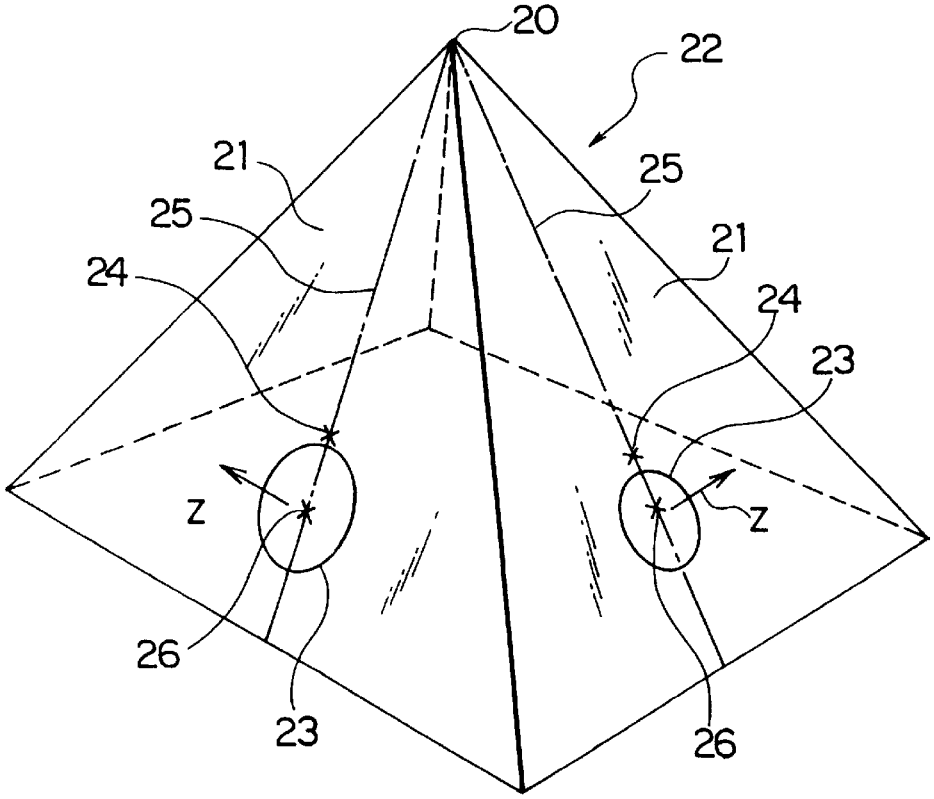
FIG. 8 is a perspective view of the microstrip antenna according to a fourth embodiment of the invention.

FIG. 8 is a perspective view showing a structure of the three-dimensional antenna according to the fourth embodiment of the invention.

The three-dimensional antenna shown in FIG. 8 is configured by assembling four dielectric substrates 21 having the shape of an equilateral triangle or an isosceles triangle and a common apex 20 into a pyramid three-dimensional substrate 22. And, a circular radiation conductor 23 as the radiating element such as the one shown in FIG. 2A and FIG. 2B is disposed on the respective dielectric substrates 21, and a grounding conductor plate as the base conductor having the same shape as the dielectric substrate 21 and a coaxial line as the feed portion, which are not illustrated, are disposed on the backsides of the respective dielectric substrates 21.

The circular radiation conductor 23 is disposed to have its center 26 on a straight line 25 running through the apex 20 and a center 24 on the main surface of each dielectric substrate 21 but different from the center 24 of the dielectric substrate 21.

In this embodiment, the center 26 of the circular radiation conductor 23 is displaced to the negative direction along the X axis from the center 24 of the dielectric substrate 21 so as to point the beam in the direction of the Z axis (in the direction of the apex) of each plane.

The antenna of this embodiment can be used for the base station or the terminal of a premises radio communication system for instance. Specifically, by selectively using the four circular radiation conductors 23 of the antenna which is disposed on the ceiling, desk or the like, the beam can be pointed to a target direction, and a high gain can be obtained in respective directions.

Figure 9:
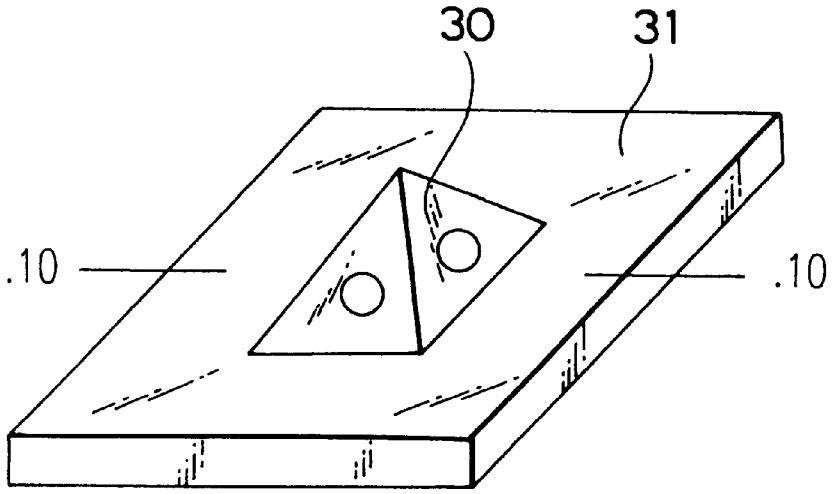
FIG. 9 is a perspective view showing an applied example of the microstrip antenna according to the fourth embodiment of the invention.
Figure 10:
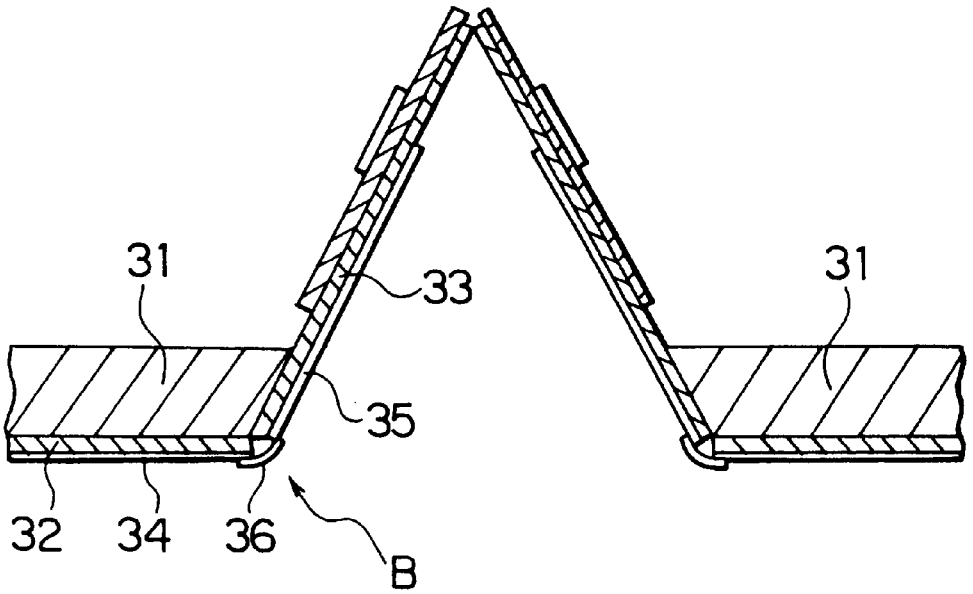
FIG. 10 is a sectional view showing an example of a conventional substrate connected portion.
Figure 11:
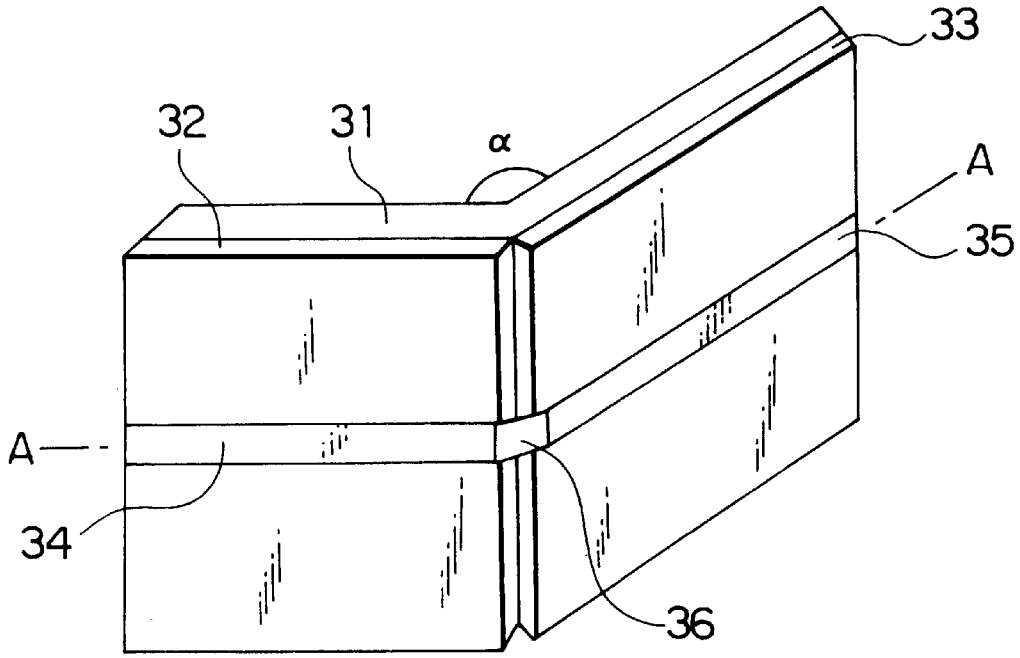
FIG. 11 PRIOR ART
FIG. 11 is a perspective view seen in the direction of B of FIG. 10.
Figure 12:
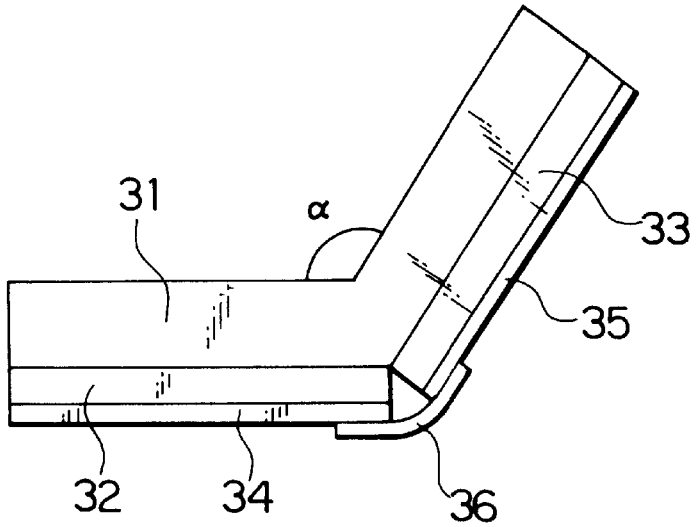
FIG. 12 PRIOR ART
FIG. 12 is a sectional view taken along line A–A' of FIG. 11.

Meanwhile, the three-dimensional antenna 30 shown in FIG. 8 is mounted on a housing 31 as shown in FIG. 9. FIG. 10 is a sectional view taken along line A–A' of FIG. 9, FIG. 11 is a partly expanded view of FIG. 10, and FIG. 12 is a view seen in the direction of B of FIG. 10. These drawings show a conventional structure, and its structural disadvantages will be described.

Figure 13:
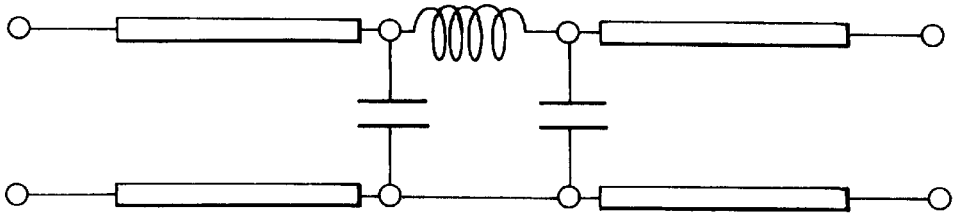
FIG. 13 PRIOR ART
FIG. 13 is an equivalent circuit diagram of a a conventional substrate connected portion.

A substrate 32 is disposed on the backside of the housing 31. The substrate 32 is adjacent to a substrate 33 at a relative angle α. A transmission line 34 on the substrate 32 and a transmission line 35 on the substrate 33 are a microstrip line, and both the substrates 32, 33 are adhered to the metal housing 31 with a conductive adhesive agent or the like. The transmission line 34 and the transmission line 35 are mutually connected at a connection part 36 by, for example, wire bonding with a gold wire or welding with a gold ribbon. At the time, grounding is made by bonding to the same metal housing 31 with a conductive adhesive agent.

Where the two lines 34, 35 are mutually connected by wire bonding with a gold wire or welding with a gold ribbon, the gold wire or gold ribbon as the connection part 36 has inductance at a high frequency bands such as a microwave or millimetric wave. And, the substrates 32, 33 have capacitance at their end. Therefore, an equivalent circuit becomes as shown in FIG. 13. To reduce unneeded reactance or capacitance shown in FIG. 13, the gold wire or gold ribbon as the connection part 36 is required to be as short as possible.

However, in the three-dimensional structure shown in FIG. 10 to FIG. 12, the gold wire or gold ribbon as the connection part 36 may have a hollow portion due to a thickness of the substrates or an angle formed between the connected substrates. Therefore, it is very hard to thoroughly eliminate inductance, and mismatching may be caused. Especially, in the millimeter wave band, unneeded radiation is high from the discontinuous part such as the connection part 36 shown in the drawings, and an insertion loss at the connection part becomes high. Besides, since wire bonding or welding is required to be performed three-dimensionally to connect the transmission line 34 with the transmission line 35, there are disadvantages that a special jig is required, and the number of steps is increased.

A fifth embodiment is to remedy such disadvantages.

Figure 14:
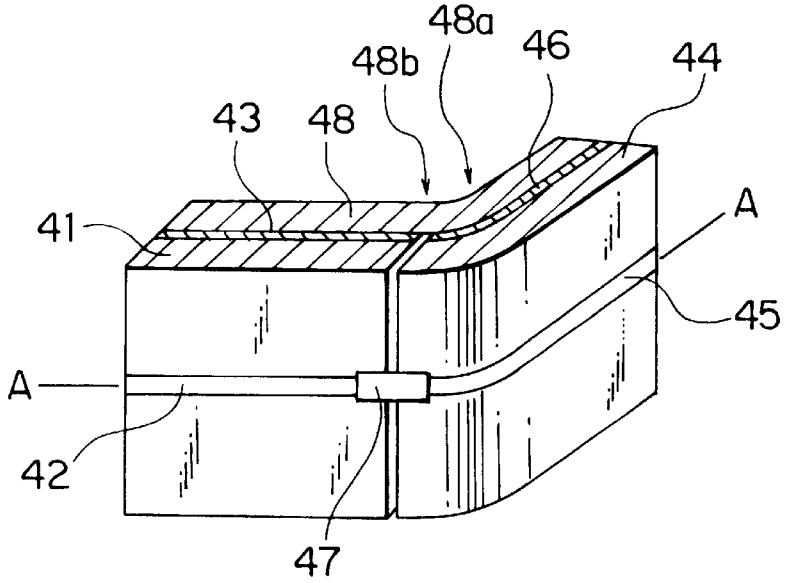
FIG. 14 is a perspective view of the substrate connection device according to a fifth embodiment of the invention.
Figure 15:
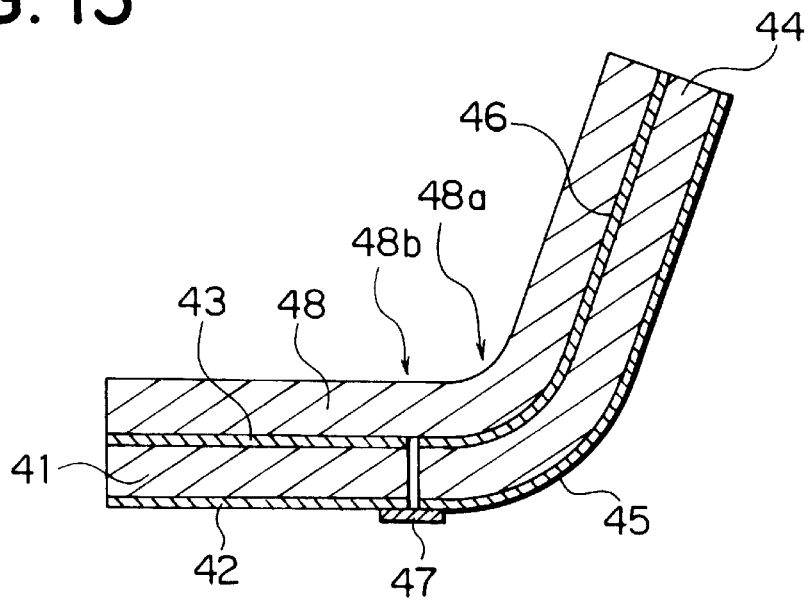
FIG. 15 is a sectional view taken along A–A' of FIG. 14.

FIG. 14 and FIG. 15 show a substrate-substrate connecting device according to the fifth embodiment of the invention. FIG. 14 is a perspective view showing two substrates which are connected by the substrate-substrate connecting device according to the fifth embodiment of the invention, and FIG. 15 is a sectional view taken along line A–A' of FIG. 14.

By the substrate-substrate connecting device of the fifth embodiment, a microstrip line 42 is formed on a first flat dielectric substrate 41, and a grounding conductor plate 43 is fixed to a metal housing 48 with a conductive adhesive agent or soldering. On the other hand, a microstrip line 45 is formed on a second dielectric substrate 44 which is formed along a bent portion 48*a* of the metal housing 48, and a grounding conductor 46 of the substrate is fixed to the metal housing 48 with a conductive adhesive agent. The microstrip line 42 as the first transmission line and the microstrip line 45 as the second transmission line are mutually connected with a gold ribbon 47 as the connection part on a flat portion 48*b* of the metal housing 48.

In this embodiment, the second dielectric substrate 44 is bent along the bent portion 48*a* at such a curvature that the transmission characteristic of the microstrip line 45 is not deteriorated, thereby preventing the first substrate and the second substrate from being connected mutually at an acute angle. Here, the substrate is bent along the curvature with the grounding conductor 46 fixed to the metal housing 48 with a conductive adhesive agent or soldering. Similarly, the grounding conductor 43 of the first dielectric substrate is fixed to the metal housing 48 with a conductive adhesive agent or soldering. Thus, they are commonly grounded. And, since the adjacent parts are positioned on the flat portion 48*b* of the metal housing 48, the respective lines are easily aligned, and welding and other steps can be facilitated.

Figure 16:
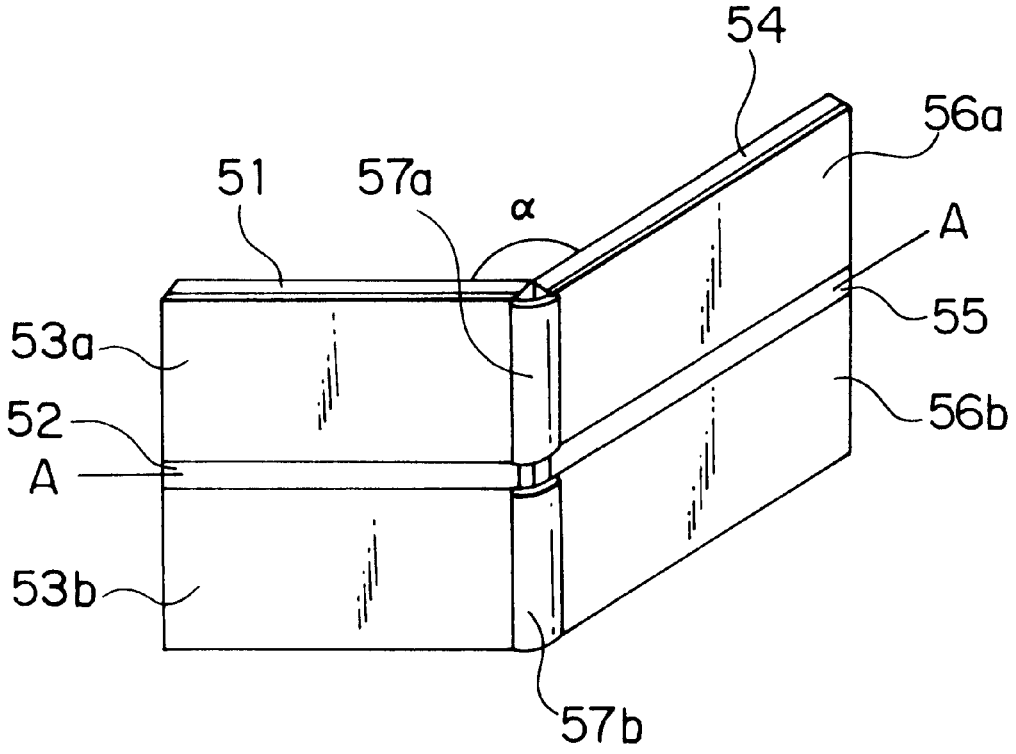
FIG. 16 is a perspective view of the substrate connection device according to a sixth embodiment of the invention.
Figure 17:
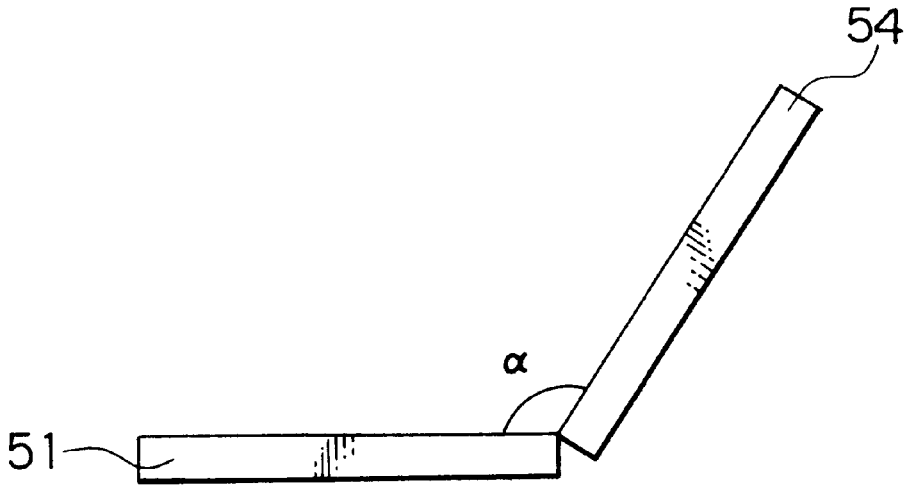
FIG. 17 is a sectional view taken along line A–A' of FIG. 16.

FIG. 16 and FIG. 17 shows the substrate-substrate connecting device according to a sixth embodiment of the invention. FIG. 16 is an appearance view of two substrates mutually connected by the substrate-substrate connecting device according to the sixth embodiment, and FIG. 17 is a sectional view taken along line A–A' of FIG. 16.

By this substrate-substrate connecting device, a slot line 52 is formed of a slit which is formed between grounding conductors 53*a*, 53*b* on a first flat dielectric substrate 51. On the other hand, a slot line 55 is formed of a slit which is formed between grounding conductors 56*a*, 56*b* on a second flat dielectric substrate 54 having an angle α with respect to the first dielectric substrate 52. The slot line 52 as the first transmission line and the slot line 55 as the second transmission line are mutually connected by welding between the grounding conductors 53*a* and 56*a* and between the grounding conductors 53*b* and 56*b* with gold ribbons 57*a* and 57*b* at each contacted point.

Figure 18:
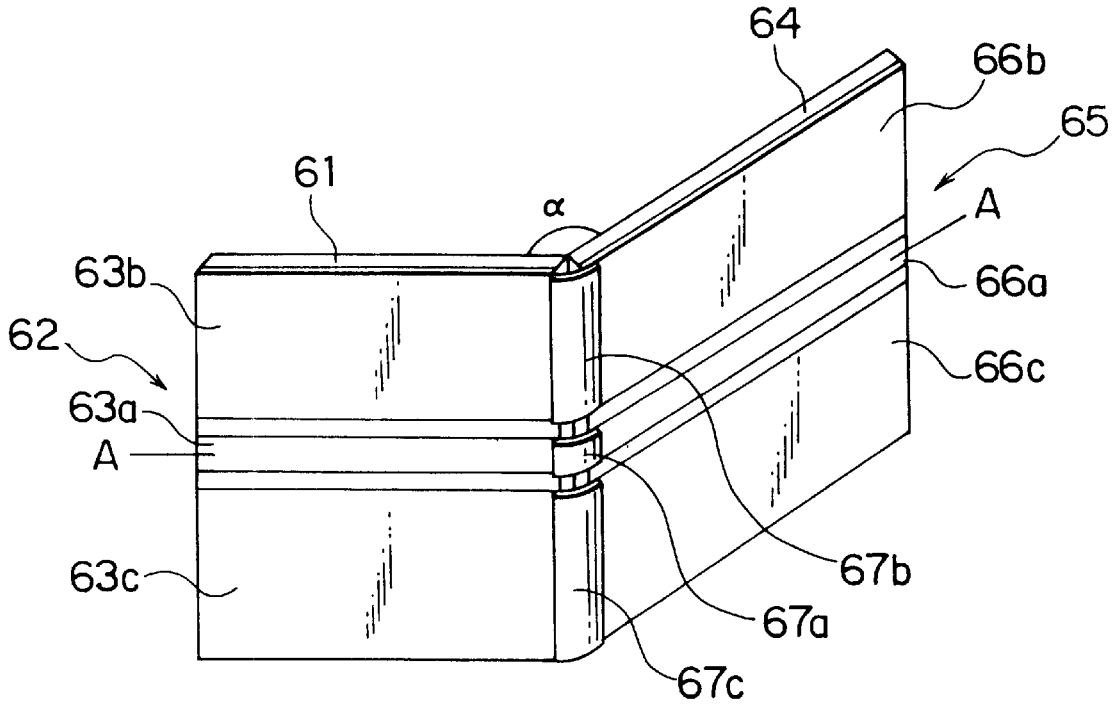
FIG. 18 is a perspective view of the substrate connection device according to a seventh embodiment of the invention.
Figure 19:
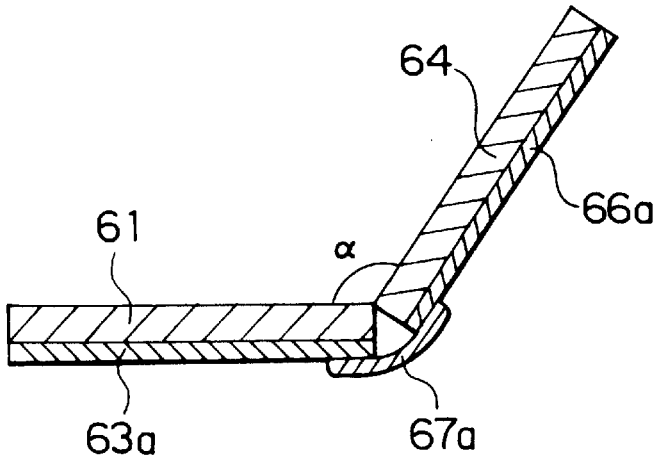
FIG. 19 is a sectional view taken along line A–A' of FIG. 18.

FIG. 18 and FIG. 19 show the substrate-substrate connecting device according to a seventh embodiment of the invention. FIG. 18 is an appearance view showing two substrates connected by the substrate-substrate connecting device according to the seventh embodiment, and FIG. 19 is a sectional view taken along line A–A' of FIG. 18.

By this substrate-substrate connecting device, a center conductor 63*a* of a coplanar waveguide 62 is formed of a slit which is formed between grounding conductors 63*b* and 63*c* on a first flat dielectric substrate 61. On the other hand, a center conductor 66*a* of a coplanar waveguide 65 is formed of a slit which is formed between grounding conductors 66*b*, 66*c* on a second flat dielectric substrate 64 having an angle α with respect to the first dielectric substrate 61. The coplanar waveguide 62 as the first transmission line and the coplanar waveguide 65 as the second transmission line are mutually connected by welding between the center conductors 63*a* and 66*a*, between the grounding conductors 63*b* and 66*b*, and between the grounding conductors 63*c* and 66*c* with gold ribbons 67*a*, 67*b* and 67*c* at each contacted point.

Figure 20:
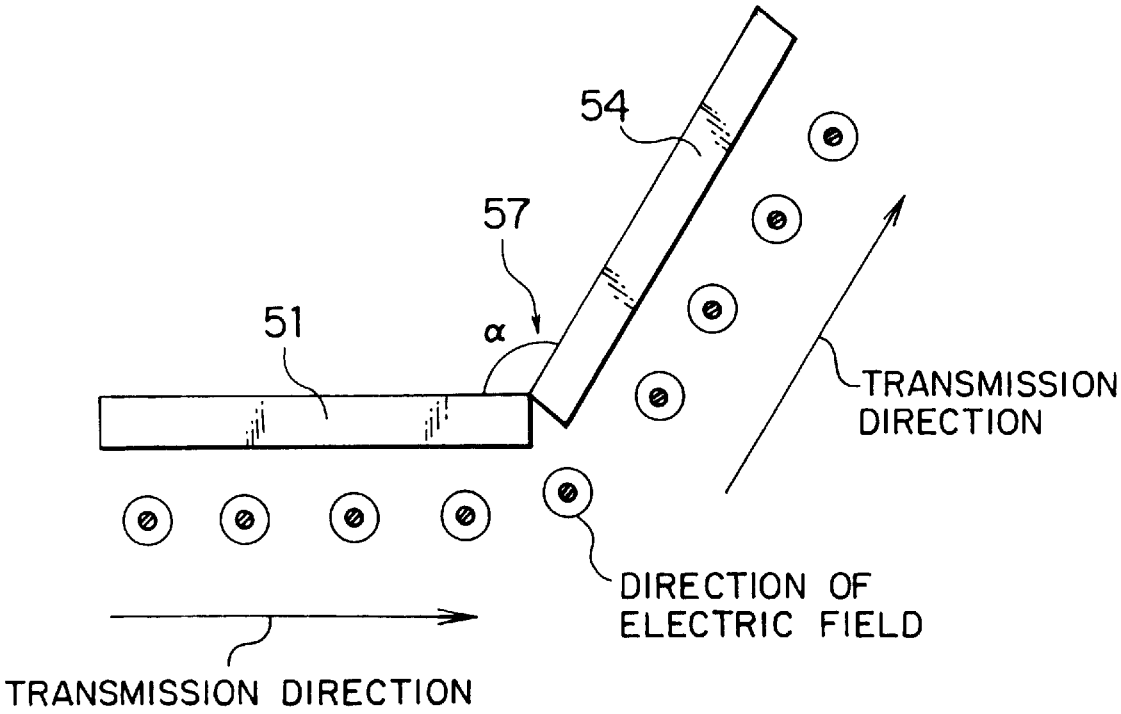
FIG. 20 is a diagram showing a direction of electric field through a line of the substrate-substrate connection device according to the sixth embodiment of the invention.

FIG. 20 shows a direction of electric field on the plane A–A' according to the sixth embodiment. Since the slot line is used, the electric field in the line is parallel with respect to the surface of the substrate and also perpendicular with respect to the transmission direction. It is apparent from the drawing that the direction of transmission is changed at the connection part 57 by an angle α, but the direction of electric field does not change. This is also applied to the coplanar waveguide in the seventh embodiment described above. The slot line and the coplanar waveguide are different to each other only on the point that the coplanar waveguide has the directions of electric fields mutually reversed in the two slits. In the same way as the slot line, the direction of electric field in the line does not change even if the substrates are mutually connected for the coplanar waveguide.

Figure 21:
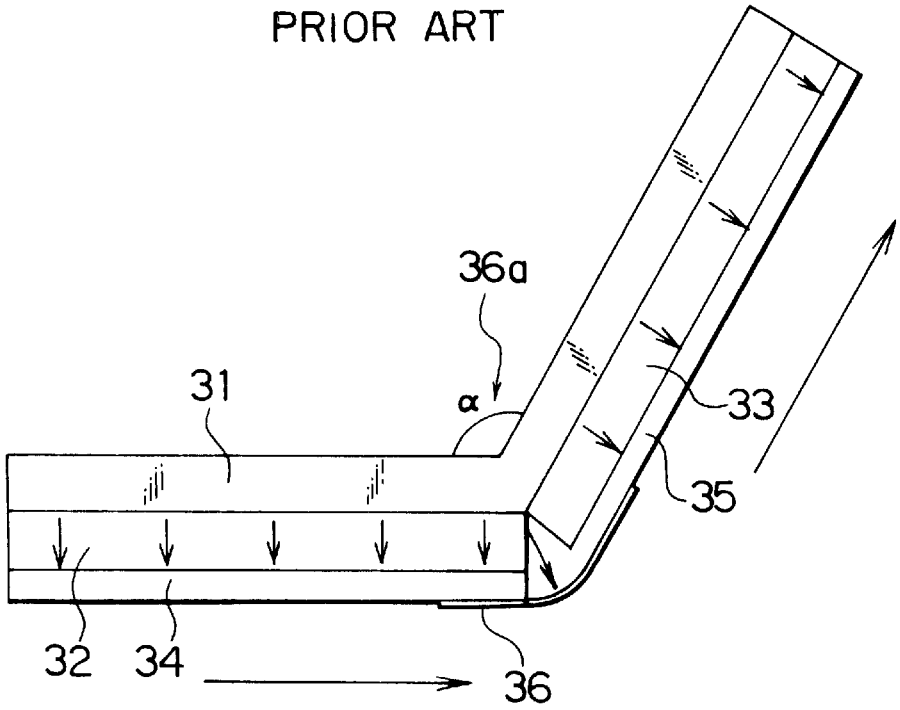
FIG. 21 PRIOR ART
FIG. 21 is a diagram showing a direction of electric field through a line of the substrate-substrate connected portion.

On the other hand, FIG. 21 shows a direction of electric field in the line on the plane A–A' when the prior substrate—substrate connecting device shown in FIG. 10 to FIG. 12 is used. Since electromagnetic waves propagate in a TEM mode through the microstrip line, electric fields are perpendicular with respect to the propagation direction and the substrate surface. Where the first transmission line 34 is connected to the second transmission line 35 which is on the second dielectric substrate 33 which is disposed at an angle $\alpha$ with respect to the first dielectric substrate 32 at the connection point 36*a*, the direction of the electric field propagating from, for example, the first transmission line 34 is sharply changed by the angle $\alpha$ at the connection point 36*a* of the two substrates. Therefore, the transmission characteristics are adversely affected.

The substrate-substrate connecting devices according to the fifth to seventh embodiments are generally applied to the so-called pyramid antenna shown in FIG. 8 to FIG. 10 but may also be applied to other types of antennas or systems.

In the fifth embodiment of the invention, the microstrip line was used, but a transmission line for a plane circuit such as a triplate line or a twin lead may also be used.

And, in the sixth and seventh embodiments, although nothing is formed on the side opposite to the side where the line is formed, a separate grounding conductor may be disposed as a grounded slot line or a grounded coplanar line. At this time, a metal housing may be disposed in the same way as in the fifth embodiment to adhere thereto.

Figure 22:
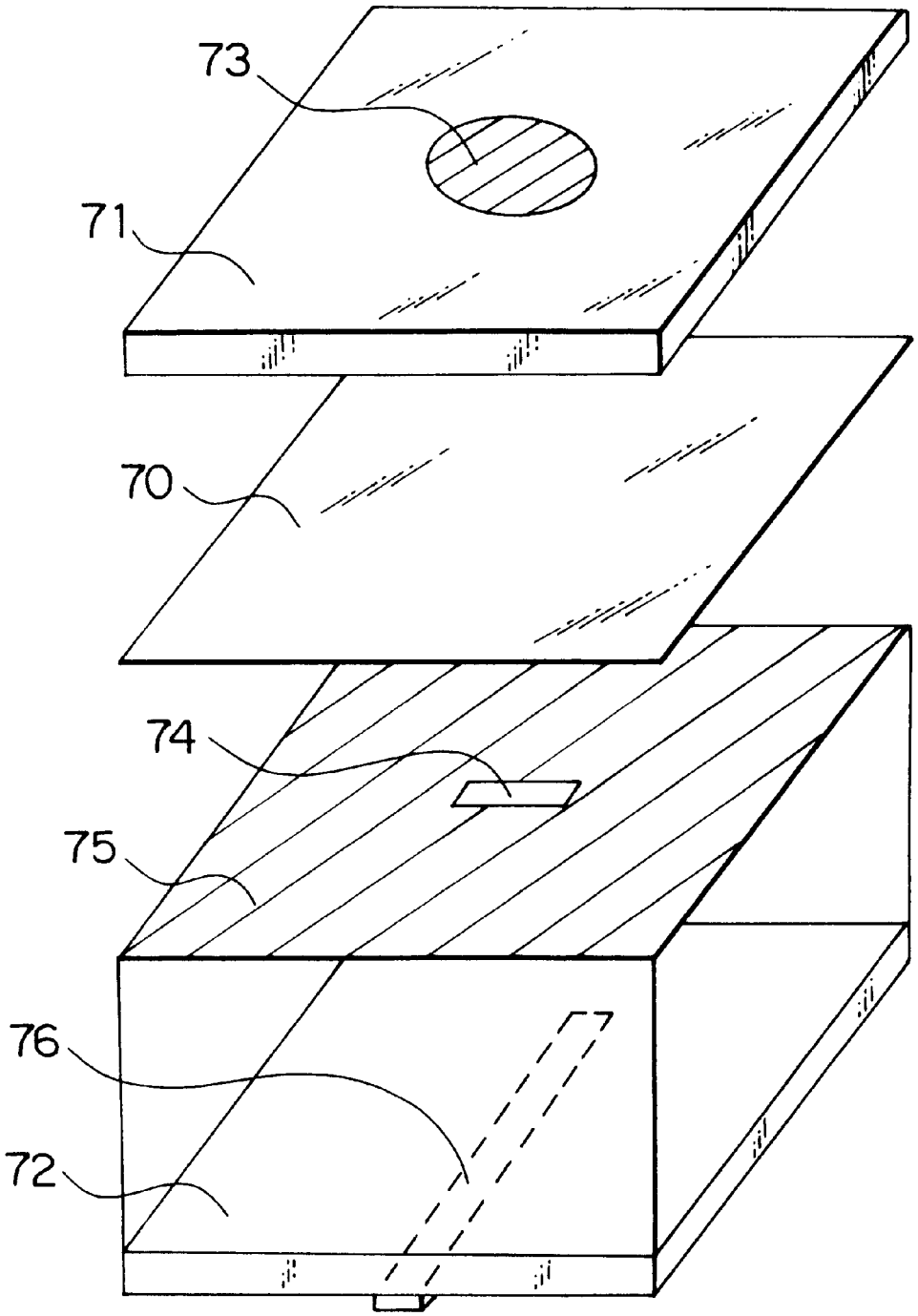
FIG. 22 PRIOR ART
FIG. 22 is an exploded perspective view showing a conventional microstrip antenna.
Figure 23:
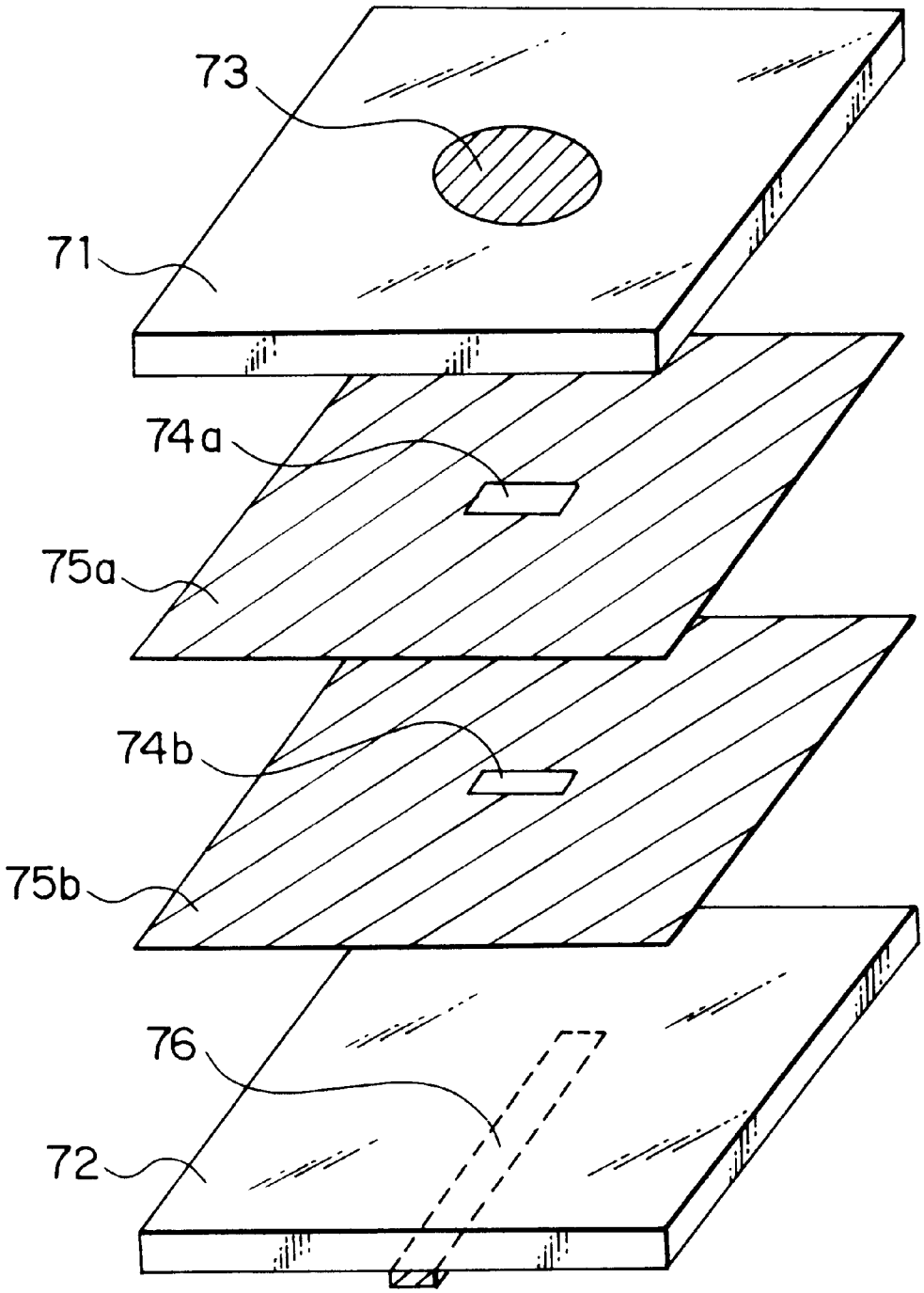
FIG. 23 PRIOR ART
FIG. 23 is an exploded perspective view showing another conventional microstrip antenna.

A slot coupling type microstrip antenna such as the three-dimensional antenna 30 shown in FIG. 8 is known to have the substrate on the side of the feed line and the substrate on the side of the radiation conductor bonded together by two methods. According to one of them, as shown in FIG. 22, an adhesive agent or adhesive sheet 70 is placed between two substrates 71 and 72 (a radiation conductor 73 is formed on the surface of the substrate 71, and a base conductor 75 with an opening 74 for connection and a feed line 76 are formed on the front and back surfaces of the substrate 72 respectively) and melted to adhere them. This method requires that the substrates are the same kind and resistant against a pressure to a prescribed magnitude, such as a PTFE substrate. Therefore, available substrates are limited. And, this method cannot improve a radiation efficiency by having the substrate on the side of the radiation conductor with a low dielectric constant or improve integrity of a circuit by having the substrate on the side of the feed line with a high dielectric constant. According to the other method, as shown in FIG. 23, grounding conductors 75*a*, 75*b* which have joining openings 74*a*, 74*b* formed respectively are placed between both surfaces of two substrates 71, 72 which are mutually bonded, and reflowing of a solder such as a gold-tin solder is performed to adhere them. This method can adhere for example a PTFE substrate with an alumina substrate or a gallium arsenide substrate. But, since the joining openings have a length of 1 mm or below and a width of 0.1 mm or below in the millimeter wave band for instance, the reflowed solder flows into the slot to fill it, so that there is a disadvantage that power cannot be supplied to the radiation conductor. The disadvantages described above also take place in a microstrip coupler between multilayered configration.

Such disadvantages can be remedied by an eighth embodiment.

Figure 24:
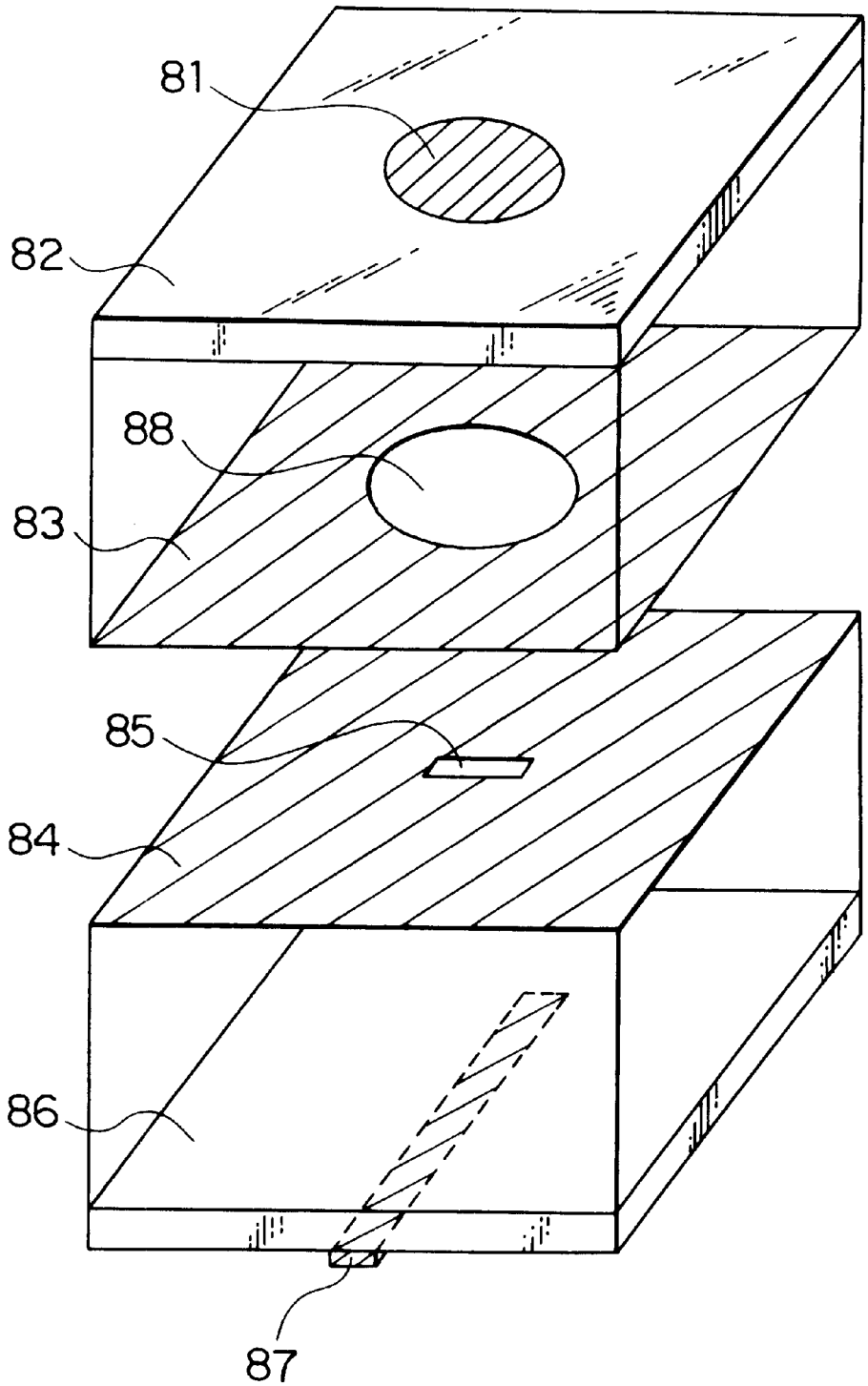
FIG. 24 is an exploded perspective view showing the microstrip antenna according to an eighth embodiment of the invention.

FIG. 24 shows the microstrip antenna according to the eighth embodiment of the invention. In the microstrip antenna of the eighth embodiment, a first dielectric substrate 82 is held between a radiation conductor 81 and a first grounding conductor 83, and a second dielectric substrate 86 to be adhered with the first dielectric substrate 82 is held between a second grounding conductor 84 and a feed line 87. A joining opening 85 is formed on the second grounding conductor 84 to connect the radiation conductor 81 and the feed line 87, and the first grounding conductor 83 has its metal partly removed to form an opening 88 which is located in the neighborhood of the joining opening 85 on the second grounding conductor 84. Specifically, the opening 88 has an area larger than the joining opening 85 and surrounds the joining opening 85 therein. The first dielectric substrate 82 and the second dielectric substrate 86 are electromagnetically connected by reflowing a solder between the first grounding conductor 83 and the second grounding conductor 84.

By joining them, the opening 88 which is formed by removing the metal includes the joining opening 85, so that the solder is prevented from flowing therein.

Figure 25:
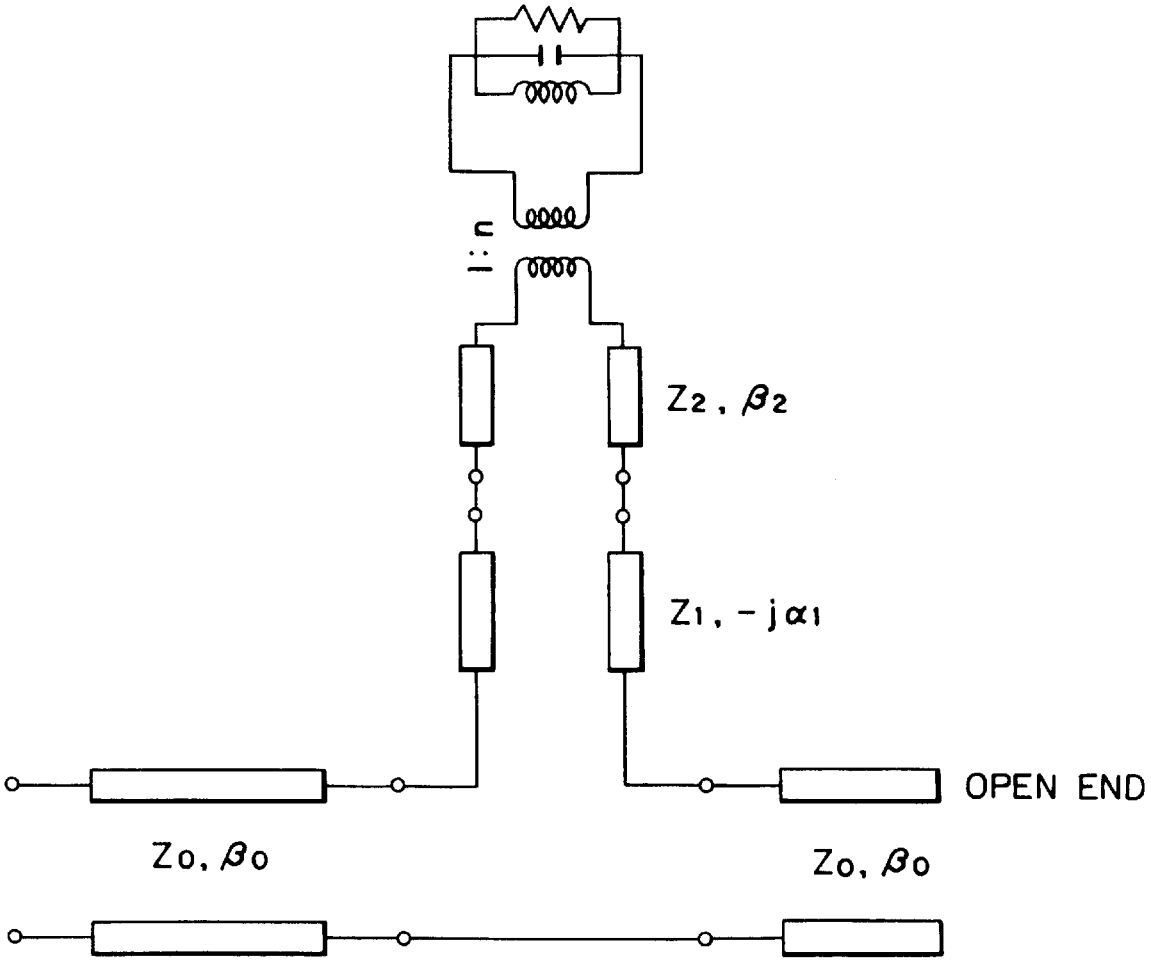
FIG. 25 is a diagram showing an equivalent circuit of the microstrip antenna according to the eighth embodiment of the invention.
Figure 26:
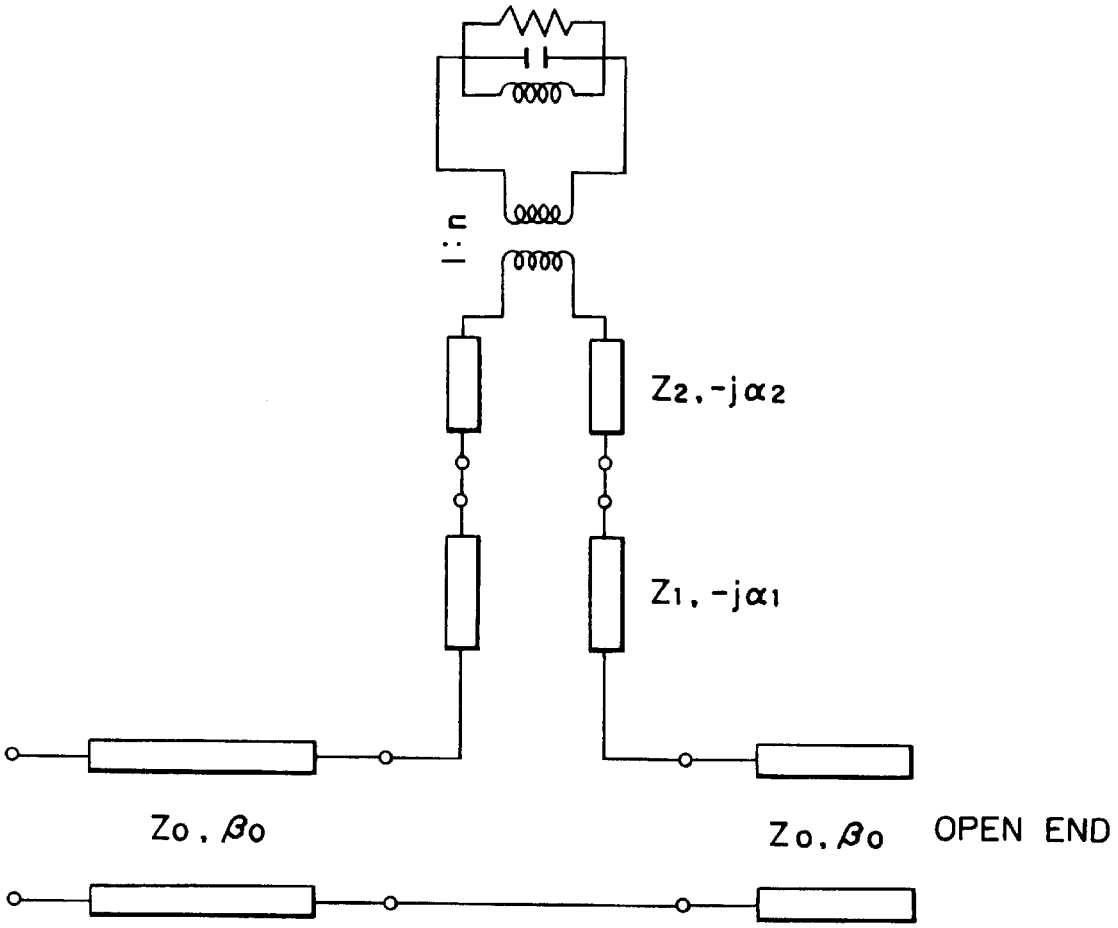
FIG. 26 PRIOR ART
FIG. 26 is a diagram showing the equivalent circuit of a conventional microstrip antenna.

FIG. 25 shows an equivalent circuit of the microstrip antenna according to the eighth embodiment shown in FIG. 24. In FIG. 25, a propagation constant $-\alpha_1$ (attenuation constant $\alpha_1$) derives from the joining opening 85 which is formed on the grounding conductor especially in the millimeter wave band or above appears to be an evanescent metal waveguide. Therefore, the conventional microstrip antenna as shown in FIG. 23 has an equivalent circuit as shown in FIG. 26, and electromagnetic waves have attenuate to a large extent for the thickness of the grounding conductor on the side of the first dielectric. But, when the opening 88 which is formed by partly removing the metal of the first grounding conductor 83 shown in FIG. 24 has a size of a metal waveguide of a cut-off frequency or above, attenuation for the equivalent extent can be lowered, so that a loss of the antenna feed can be reduced.

Figure 27:
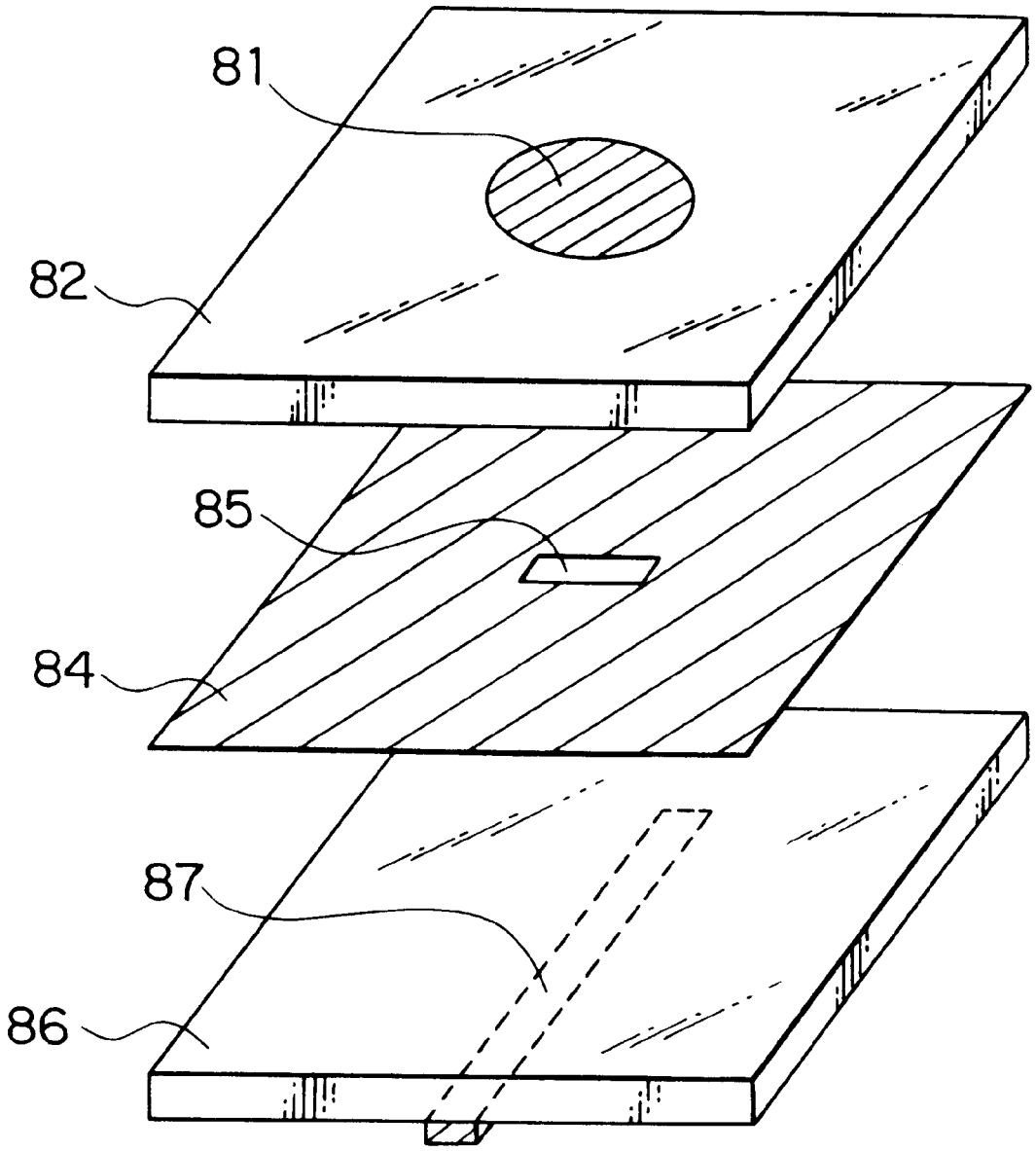
FIG. 27 PRIOR ART
FIG. 27 is an exploded perspective view showing a conventional microstrip antenna.
Figure 28:
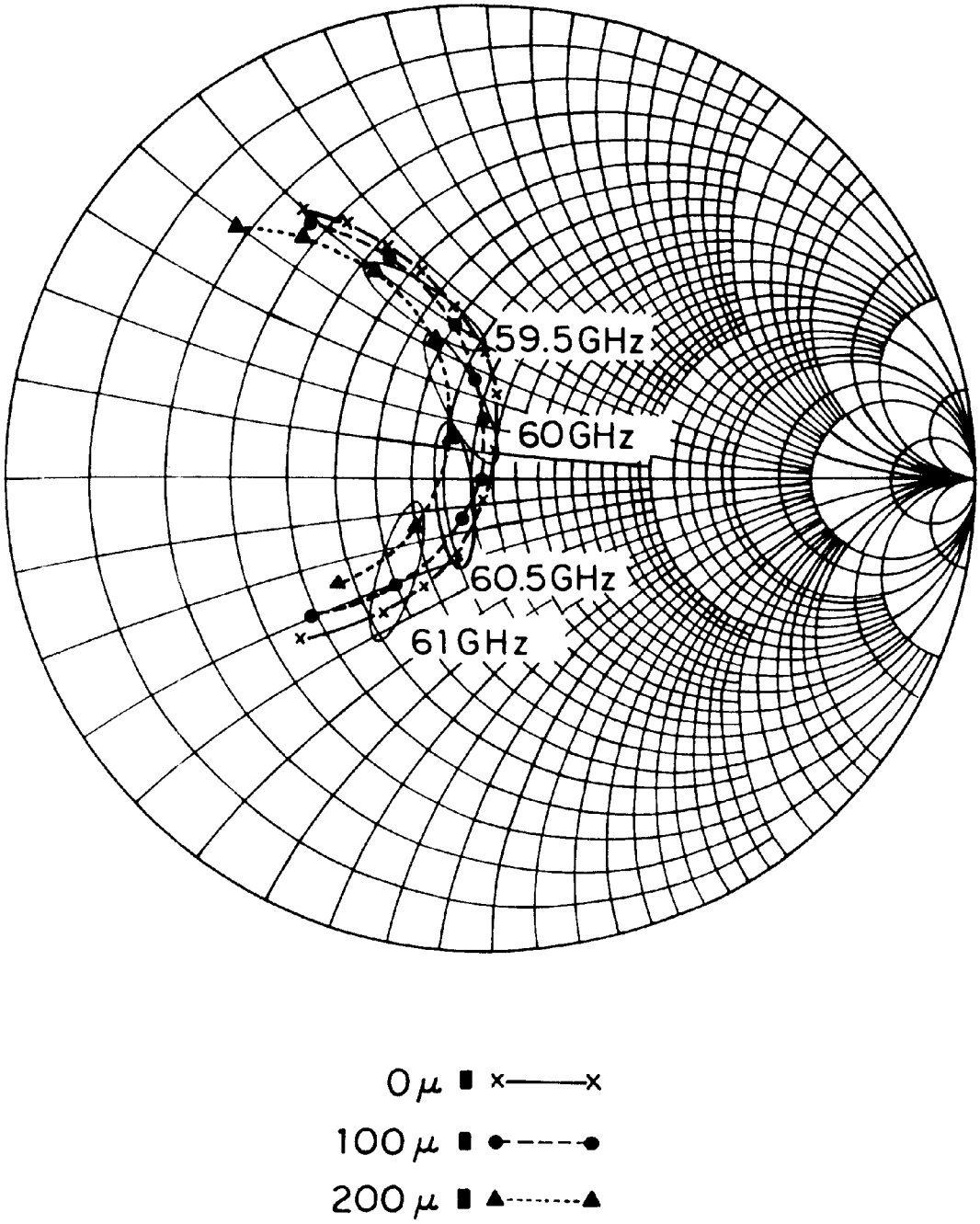
FIG. 28 PRIOR ART
FIG. 28 is a diagram showing changes in input impedance upon displacing the radiation conductor of the microstrip antenna of FIG. 27.
Figure 29:
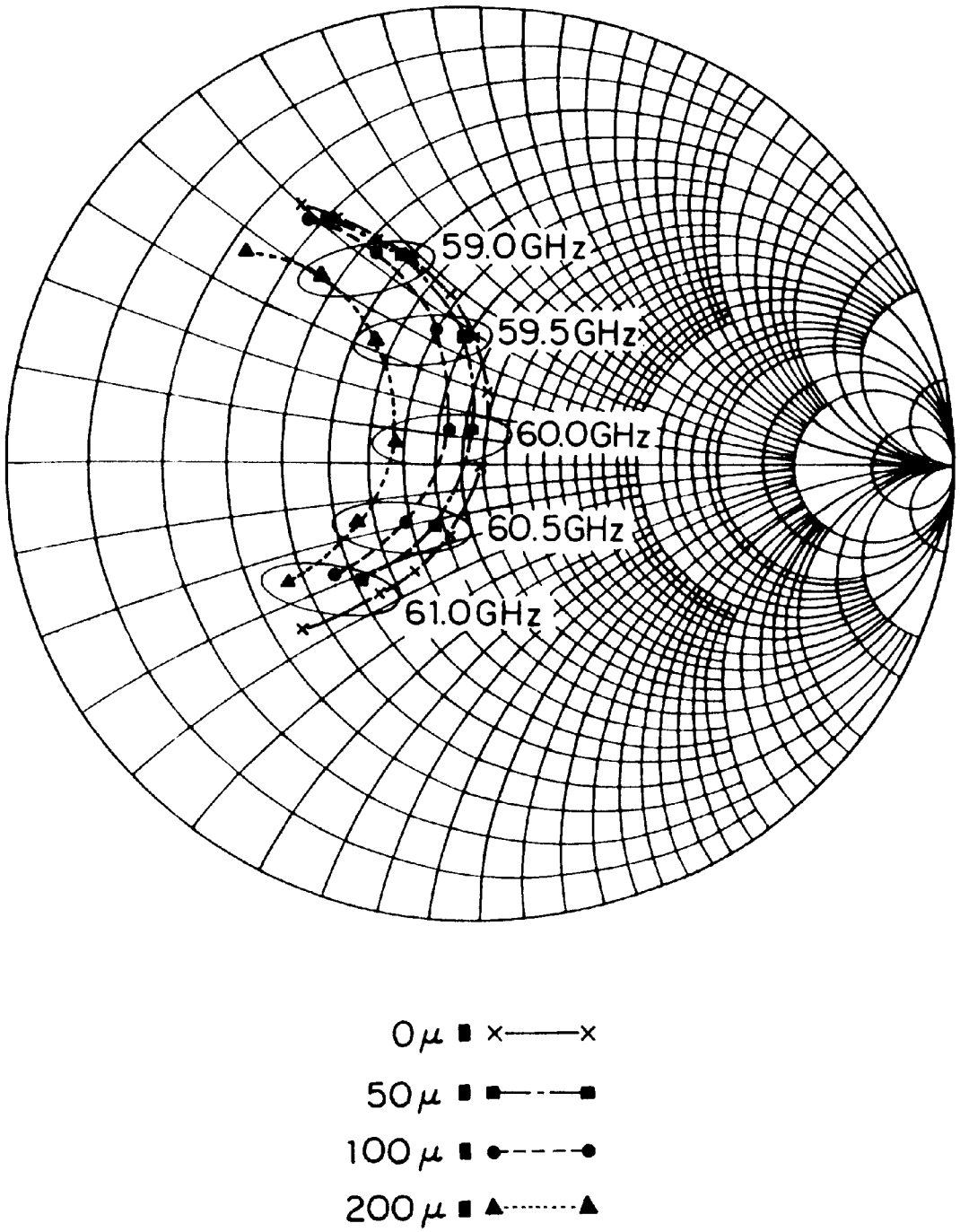
FIG. 29 PRIOR ART
FIG. 29 is a diagram showing changes in input impedance upon displacing the feed line of the microstrip antenna of FIG. 27.

FIG. 28 shows the changes of an input impedance characteristic determined by computer simulation with the radiating conductor 81 displaced from the center of the joining opening 85 in a direction of Y axis in the slot coupling type microstrip antenna (elements same as those shown in FIG. 24 are indicated by like reference numerals) shown in FIG. 27, and FIG. 29 shows the changes of an input impedance characteristics calculated by computer simulation with the feed line 87 displaced from the center of the joining opening 85 to a direction of Y axis. Parameters of the slot coupling type microstrip antenna used for computation are as follows.

(1) Dielectric constant of the dielectric substrate 82: 2.20; its thickness: 0.127 mm (2) Dielectric constant of the dielectric substrate 86: 2.20; its thickness: 0.127 mm (3) Radius of the circular radiation conductor 83: 0.91 mm (4) Joining rectangular opening 85: 0.7 mm long×0.1 mm wide (5) Characteristic impedance of the feed line 87: 50 Ω

It is apparent from FIG. 28 and FIG. 29 that the changes of the input impedance characteristic to the offset volume are higher in FIG. 29 than in FIG. 28. Actually, it is seen from the drawings that 50 $\mu$m is required as relative position accuracy between the joining opening 85 and the feed line 87, and 100 $\mu$m is required as relative position accuracy between the joining opening 85 and the radiation conductor 81 to maintain required return loss band width of 1 GHz.

Therefore, the joining opening 85 is formed by etching or the like on the grounding conductor 84 of the second dielectric 86, so that the position accuracy required to bond the two substrates can be lowered. Accordingly, in the first embodiment shown in FIG. 24, it is desirable that the joining opening 85 is formed on the second grounding conductor 84, and the opening 88 which is formed by removing the metal is formed in the first grounding conductor 83. But, it is also possible to form the opening 88 which is formed by removing the metal on the second grounding conductor 84, and the joining opening 85 on the first grounding conductor 83.

Figure 30:
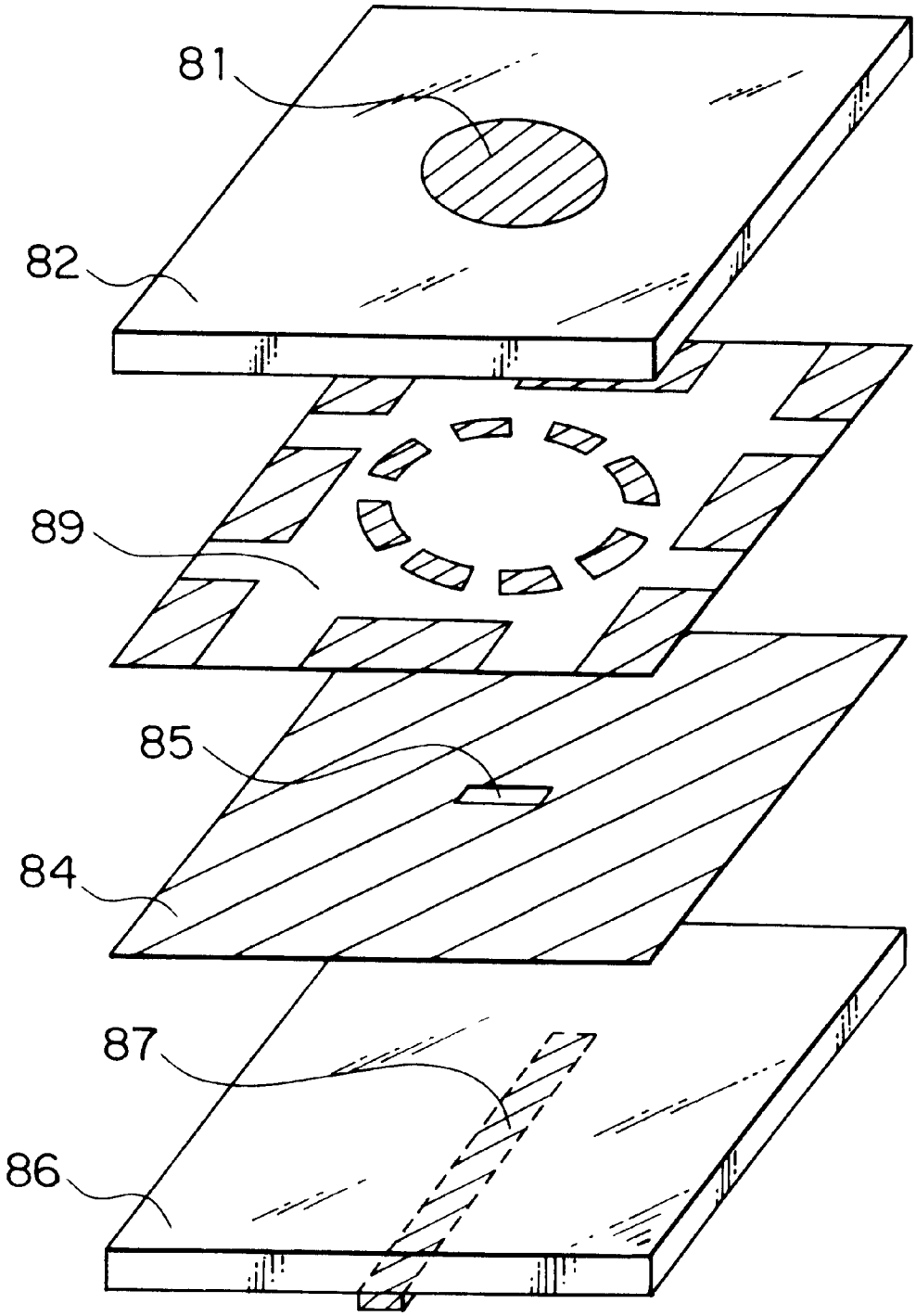
FIG. 30 is an exploded perspective view of the microstrip antenna according to a ninth embodiment of the invention.

FIG. 30 shows the microstrip antenna according to a ninth embodiment of the invention. The microstrip antenna of the ninth embodiment has the radiation conductor 81 formed on one surface of the first dielectric substrate 82, and the second dielectric substrate 86 which is bonded with the first dielectric substrate 82 held between the grounding conductor 84 and the feed line 87. The joining opening 85 is formed on the grounding conductor 84 to connect the radiation conductor 81 and the feed line 87. On the other surface of the first dielectric 82 different from the surface on which the radiation conductor 81 is formed, a substrate bonding metal 89 is disposed to adhere to the second dielectric substrate 86 by reflowing a solder. Since the solder is concentrated on the substrate bonding metal 89 by bonding, the solder can be prevented from flowing to undesired portions.

Figure 31:
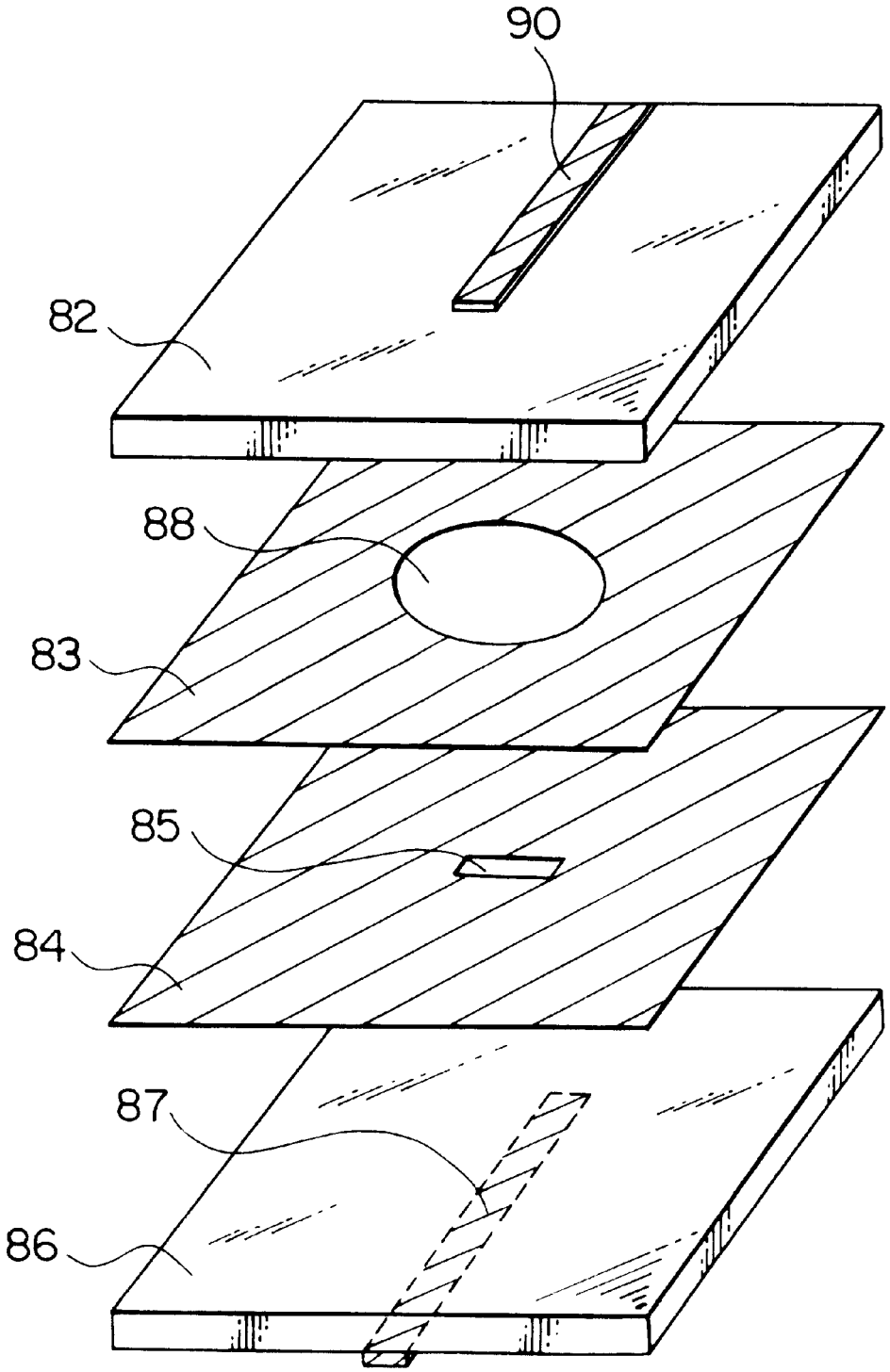
FIG. 31 is an exploded perspective view of the coupler antenna according to a tenth embodiment of the invention.

FIG. 31 shows the microstrip coupler according to a tenth embodiment. The microstrip coupler of the tenth embodiment has a first dielectric substrate 82 held between a first transmission line 90 and a first grounding conductor 83, and a second dielectric substrate 86 which is bonded to the first dielectric substrate 82 held between a second grounding conductor 84 and a second transmission line 87. A joining opening 85 is formed on the second grounding conductor 84 to bond the first transmission line 90 and the second transmission line 87. An opening 88 which is formed by removing metal is formed on the first grounding conductor 83 in the neighborhood to overlap the joining opening 85 of the second grounding conductor 84. The first dielectric substrate 82 and the second dielectric substrate 86 are electromagnetically connected by reflowing a solder between the first grounding conductor 83 and the second grounding conductor 84. When they are bonded, since the opening 88 which is formed by removing the metal is positioned in the neighborhood of the joining opening 85, and has a large area the joining opening 85, the solder can be prevented from flowing into it.

In this embodiment, the joining opening 85 is formed on the second grounding conductor 84 and the opening 88 which is formed by removing the metal is formed on the first grounding conductor 83, but the joining opening 85 may be formed on the first grounding conductor 83 and the opening 88 which is formed by removing the metal may be formed on the second grounding conductor 84.

Figure 32:
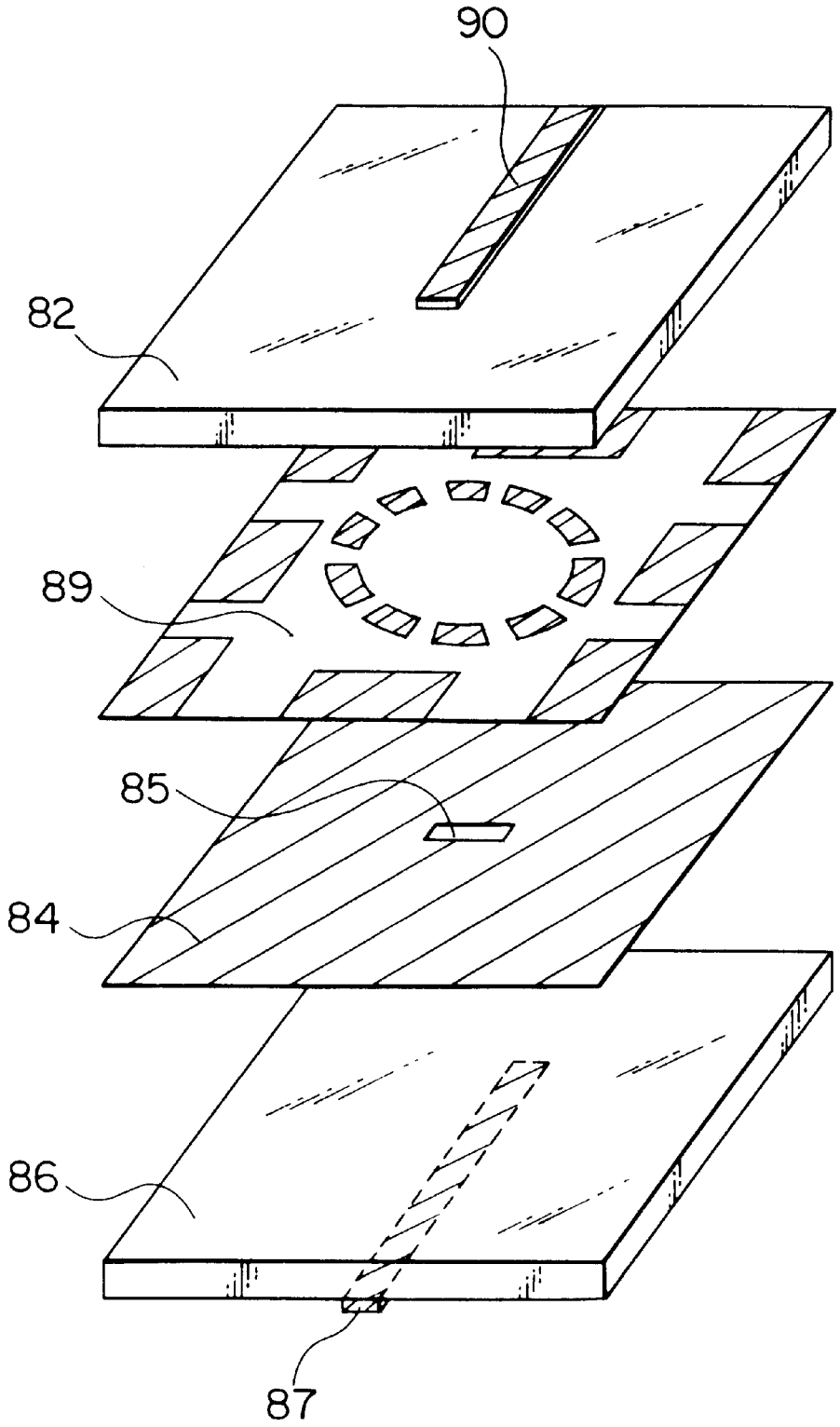
FIG. 32 is an exploded perspective view of the coupler antenna according to an eleventh embodiment of the invention.

FIG. 32 shows the microstrip coupler according to an eleventh embodiment. The microstrip coupler of the eleventh embodiment has a first transmission line 90 formed on one surface of a first dielectric substrate 82, and a second dielectric substrate 86, which is bonded with the first dielectric substrate 82, held between a grounding conductor 84 and a second transmission line 87. A joining opening 85 is formed on the grounding conductor 84 to bond the first transmission line 90 and the second transmission line 87, and on a surface of the first dielectric 82 different from the surface on which the first transmission line 90 is formed, a substrate bonding metal 89 is disposed to adhere to the second dielectric substrate 86 by reflowing a solder.

Since the solder is concentrated on the substrate bonding metal 89 by bonding, the solder can be prevented from flowing to undesired portions.

In this embodiment, the joining opening 85 is formed on the second grounding conductor 84 and the substrate bonding metal 89 is formed on the first dielectric substrate 82, but the joining opening 85 may be formed on the first grounding conductor 83 and the substrate bonding metal 89 may be formed on the second dielectric substrate 86.

This embodiment has used a circular patch antenna as the radiation conductor 81, but the invention is not limited to it and can be applied to a patch antenna having a desired shape such as rectangular, triangle, ring or the like.

Besides, the microstrip line was used for the feed line 87, the first transmission line 90 and the second transmission line 87 in this embodiment, but it may be a triplate line, coplanar waveguide, slot line or the like.

Figure 34:
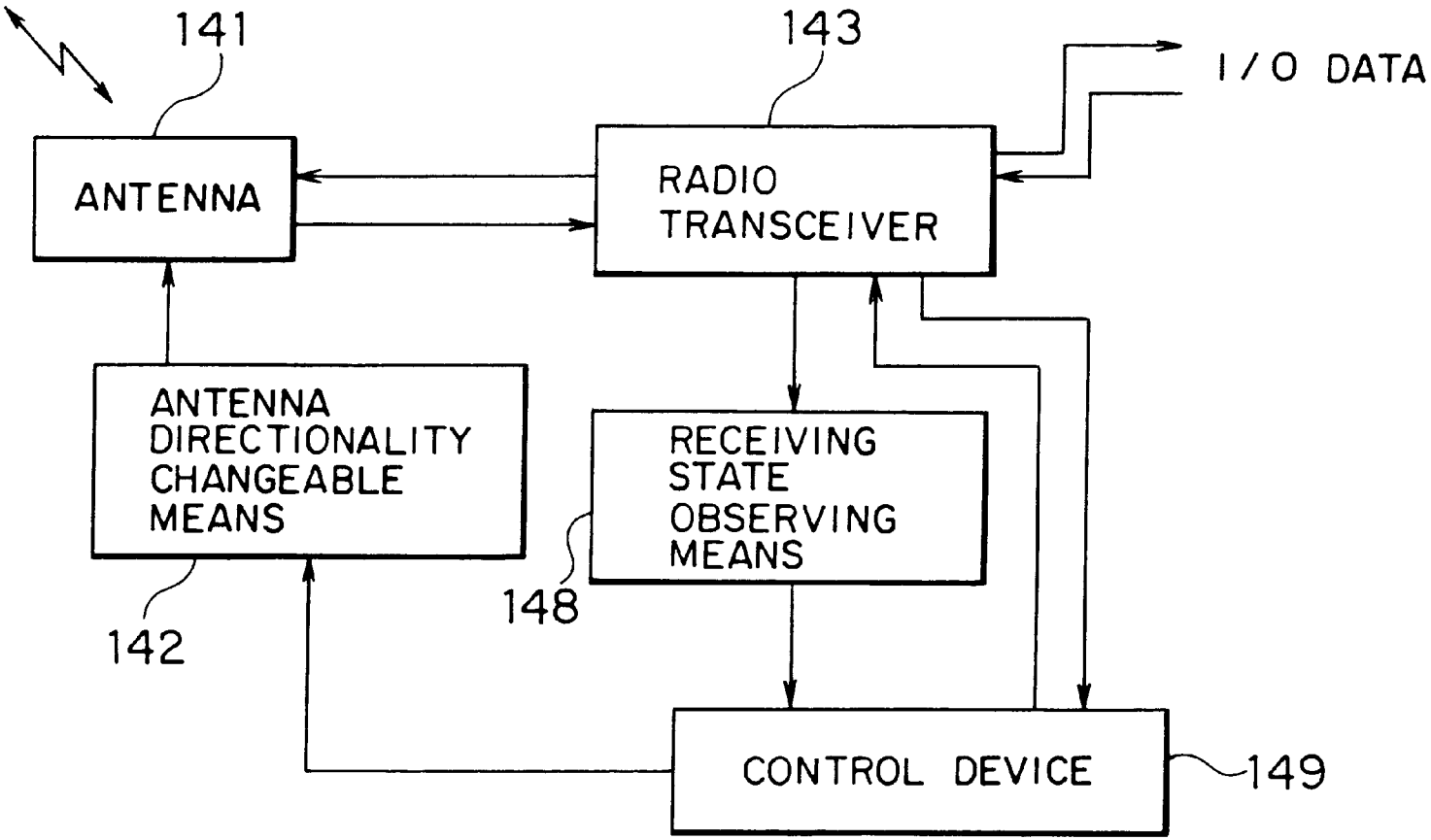
FIG. 34 is a block diagram showing the embodiment of a terminal using the antenna of the invention.

FIG. 34 is a block diagram showing an example of the terminal using the antenna of the invention. As shown in the drawing, the terminal comprises an antenna 141 which can be directional (e.g., the antennas shown in FIG. 8 and FIG. 9), an antenna radiation pattern changeable means 142, a radio transceiver 143, a receiving state observing means 148, and a control device 149.

The control device 149 of the terminal controls the operation of the radio transceiver 143. Then, radiation pattern of the terminal antenna 141 is changed by the antenna radiation pattern changeable means 142. An RF signal received by the antenna 141 is demodulated by the radio transceiver 143.

The receiving state observing means 148 observes the state of receiving demodulated signals. The receiving state observing means 148 comprises for example a received power measuring means. Output of the receiving state observing means 148 is given to the control device 149. The control device 149 operates to change, for example, the radiation pattern of the terminal antenna 141 by the antenna radiation pattern changeable means 142 to monitor the receiving conditions of respective terminal antennas, selects a direction where the receiving condition is good, and decides the radiation pattern of the antenna 141.

In this embodiment, the terminal has the antenna according to the invention, but the base station may have the antenna according to the invention.

The configurations of the terminal and the base station which are provided with the antenna according to the present invention is described in detail in Japanese Patent Application No. Hei 9-146933.

As described above, the invention comprises a substrate which has a first end portion and a second end portion which are on a straight line passing though a center on a main surface and have a different shape to each other, a patch which is disposed on the substrate so as to have the center of the main surface at a position different from the center of the substrate, and a feeder portion for supply power to the patch, so that beams can be tilted in a desired direction by virtue of a single patch and a single feeding circuit. And, the patch and the feeding circuit become single, and the center is simply displaced therefor, and a design and a jig are substantially not required to be modified. Thus, the production cost can be reduced, and since the number of components is decreased, the system can be made compact.

The invention can direct beams in a perpendicular direction even when the substrate has an asymmetric shape. And, a high gain can also be obtained.

Besides, the present invention comprises a pyramid three-dimensional substrate which is formed by assembling at least three triangle configuration having a common apex, a patch which is disposed on the respective triangle substrate so as to have the center of the patch on a straight line running through the apex and the center of the main surface of each triangle substrate but at a position different from the garavitational center of the each triangle substrate, and a feeder portion for supplying power to the respective patches, so that beams can be tilted in the direction of a desired elevation angle, and are also variable in a declination direction.

Furthermore, in connecting lines which are formed at a prescribed angle to each other, the present invention forms a bent portion which is bent at a predetermined curvature on one of two substrates to connect the lines on a flat surface of the two substrates, or uses a line such as a slot line or a coplanar waveguide on which the direction of an electric field does not change, thereby providing a connection device without suffering from a high insertion loss or requiring a new jig.

In addition, in producing an antenna or a coupler using a plurality of substrates which are bonded to one another, the present invention can achieve a microstrip antenna and a coupler with a high yield because there is no limitation due to the kinds of dielectrics or the joining opening which is formed on a grounding conductor is not filled with a reflowed solder while bonding with solder reflowing.

What is claimed is:

1. An antenna comprising:

a triangle planar substrate;

a radiation element which is disposed on the triangle planar substrate so as to have a center on a bisector which bisects a vertex angle of the triangle planar substrate, and the center position different from a median point of the triangle planar substrate; and a feeder portion configured to supply power to the radiation element.

2. An antenna comprising:

a symmetrical polygon planar substrate;

a radiation element which is disposed on the symmetrical polygon planar substrate so as to have a center on a bisector which bisects symmetrically one of vertices of the symmetrical polygon planar substrate, and the center position different from a center of gravity of the symmetrical polygon planar substrate; and a feeder portion configured to supply power to the radiation element.

3. The antenna as set forth in claim 2, wherein the substrate is triangular.

4. The antenna as set forth in claim 2, wherein the center of the radiating element is on a straight line from the first end portion to the second end portion.

5. An antenna comprising:

a pyramid three-dimensional substrate having at least three triangle planar substrates with a common vertex angle;

a plurality of radiating elements which are disposed on each of the triangle planar substrates so as to have a center on a bisector which bisects a vertex angle of each of the triangle planar substrates, and the center position different from a median point of each of the triangle planar substrates; and a plurality of feeder portions configured to supply power to each of the respective radiating elements.

6. The antenna as set forth in claim 5, wherein the three-dimensional substrate is formed of four substrates having the shape of an isosceles triangle.

7. The antenna as set forth in claim 5, wherein the feeder portion selectively supplies power to the respective radiating elements.

8. An antenna comprising:

a first grounding conductor having a first opening;

a second grounding conductor which is directly connected to the first grounding conductor with a solder, and has a second opening which has an area larger than the first opening and surrounds the first opening;

a first dielectric substrate which is attached to the second grounding conductor;

a second dielectric substrate which is attached to the first grounding conductor;

a feeder line formed on a first surface, which is an opposite surface of the first grounding conductor, of the second dielectric substrate; and a radiation conductor formed on a second surface, which is an opposite surface of the second grounding conductor, of the first dielectric substrate.

9. The antenna as set forth in claim 8, wherein:

the first dielectric substrate is adjacent to the first grounding conductor;

the second dielectric substrate is adjacent to the second grounding conductor;

the feeder line is formed on the main surface of the first dielectric substrate; and the radiation conductor is formed on the main surface of the second dielectric substrate.

10. An antenna comprising:

a first grounding conductor having an opening;

a second grounding conductor which is directly connected to the first grounding conductor with a solder at a plurality of locations located at areas outside an area defined by the opening of the first grounding conductor;

a first dielectric substrate which is attached to the second grounding conductor:

a second dielectric substrate which is attached to the first grounding conductor:

a feeder line formed on a first surface, which is an opposite surface of the first grounding conductor, of the second dielectric substrates, and a radiation conductor formed on a second surface, which is an opposite surface of the second grounding conductor, of the first dielectric substrate.

11. The antenna as set forth in claim 10, wherein the feeder line is formed on the main surface of the first dielectric substrate; and the radiation conductor is formed on the main surface of the second dielectric substrate.

12. The antenna as set forth in claim 11, wherein the opening is rectangular.

* * * * *